US006119613A

United States Patent [19]

Douyasu et al.

[11] Patent Number: 6,119,613

[45] Date of Patent: Sep. 19, 2000

[54] METHOD AND APPARATUS FOR PREVENTING A SEAM FROM RAVELING IN DOUBLE CHAIN STITCH SEWING MACHINE

[75] Inventors: Osamu Douyasu; Masami Yamanaka, both of Osaka, Japan

[73] Assignee: Pegasus Sewing Machine Mfg. Co., Ltd., Osaka, Japan

[21] Appl. No.: 09/128,745

[22] Filed: Aug. 4, 1998

[30] Foreign Application Priority Data

| | | | |
|---|---|---|---|
| Aug. 12, 1997 | [JP] | Japan | 9-230397 |
| Aug. 12, 1997 | [JP] | Japan | 9-230398 |
| Aug. 29, 1997 | [JP] | Japan | 9-235035 |

[51] Int. Cl.[7] ..... D05B 1/10

[52] U.S. Cl. ..... 112/475.17; 112/199; 112/197

[58] Field of Search ..... 112/197, 475.17, 112/199, 200, 120, 191, 253, 163, 165, 187

[56] References Cited

U.S. PATENT DOCUMENTS

| | | | |
|---|---|---|---|
| 3,386,402 | 6/1968 | Ross | 112/199 |
| 3,753,410 | 8/1973 | Kostenowczyk | 112/199 |
| 3,867,892 | 2/1975 | Ciecior et al. | 112/199 |
| 5,381,745 | 1/1995 | Nolle | 112/475.17 |
| 5,722,338 | 3/1998 | Douyasu | 112/475.17 |
| 5,769,018 | 6/1998 | Nakano | 112/475.17 |

FOREIGN PATENT DOCUMENTS

| | | |
|---|---|---|
| 5-200179 | 8/1993 | Japan . |
| 6-233877 | 8/1994 | Japan . |

*Primary Examiner*—Ismael Izaguirre
*Attorney, Agent, or Firm*—Jones, Tullar & Cooper, P.C.

[57] ABSTRACT

A method and apparatus for preventing a seam from raveling in a double chain stitch sewing machine according to the present invention are applied to sewing of cloth by a double chain stitch sewing machine. Near the sewing end point for forming a double chain stitch by collaboration of a plurality of needles and a looper, the looper thread consecutive to the looper from the cloth is hooked and engaged on the hook at the left side of the needles. After driving the sewing machine for a half stitch or one stitch in this state, the looper thread hooked on the hook is cut off. Simultaneously with this cutting or before or after the cutting, the needle thread loop consecutive to the needles from the sewing end of the cloth through the looper is cut off between the looper and the cloth. Further, capturing the cut looper thread consecutive to the looper from the cloth, the end of the cut looper thread is pulled out from the final needle thread loop at the end of sewing. Therefore, raveling of thread from the sewing end point is prevented, and the length of the thread end consecutive to the sewing end point is short, so that sewn products of good appearance may be obtained.

15 Claims, 26 Drawing Sheets

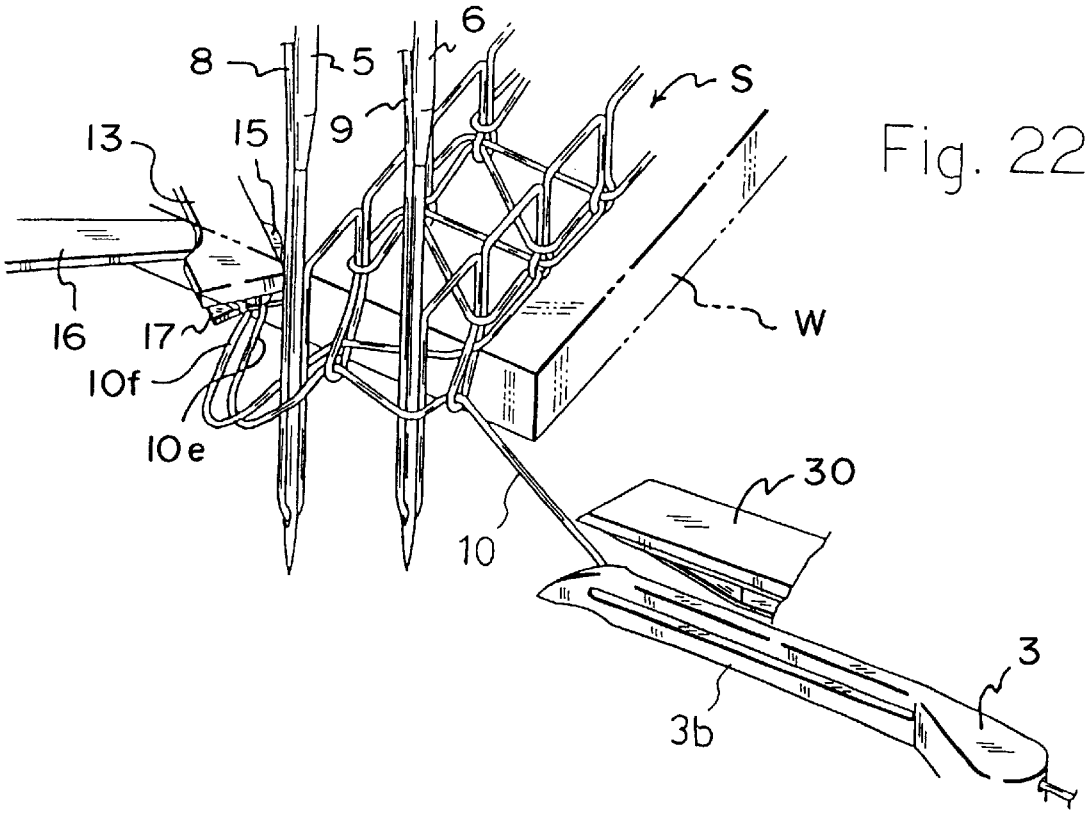
Fig. 22
Fig. 23
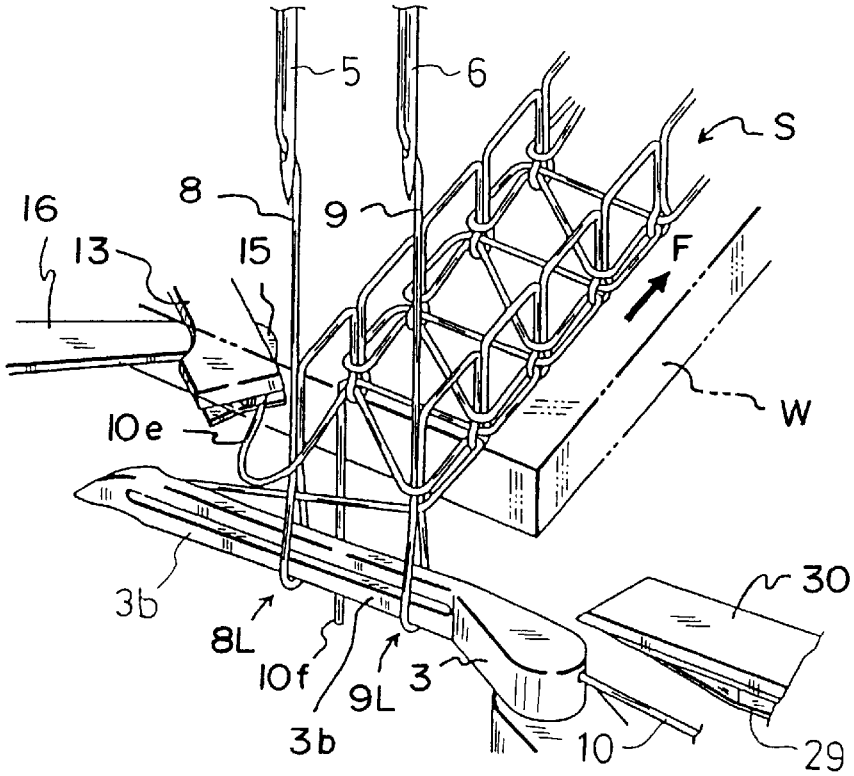

63
44
43
64
42
68a
68
58
52
52a
70
51
71
75
54
72
73
59
69
53c
56
55
47
47
46
50b
57
50
50a
48

METHOD AND APPARATUS FOR PREVENTING A SEAM FROM RAVELING IN DOUBLE CHAIN STITCH SEWING MACHINE

BACKGROUND OF THE INVENTION

1. Field of the Invention

The present invention relates to a method for preventing a sewing thread from raveling from a sewn end of a seam, in the sewing of a cloth by a double chain stitch sewing machine, which forms a double chain stitch by needle threads passed through needles moving vertically, and a looper thread passed through a looper moving forward and backward between a forward position and a backward position across the needles, and to an apparatus used for realizing such method.

2. Description of the Prior Art

When sewing a cloth with this kind of double chain stitch sewing machine, if a double chain stitch as indicated by the seam symbol 406 of Federal Standard No. 751a (JIS, Japanese Industrial Standard, L 0120), for example, is formed in the cloth, the sewing thread of this seam is raveled sequentially when the looper thread is pulled from the sewing end, and the quality of the sewn product is lowered.

To prevent the sewing thread of the double chain stitch from raveling from the sewn end, hitherto, various methods have been known, including (a) a general method of sewing by a condensed stitch at several stitches just before the sewn end, (b) a method of making the sewing thread hard to ravel by changing the tension balance of the sewing thread at the sewn end as disclosed in Japanese Laid-open Patent No. 1-317475 (Japanese patent Publication No. 6-102107) and Japanese Laid-open Patent No. 5-208082 (corresponding to U.S. Pat. No. 5,381,745), and (c) a method, as disclosed in Japanese Laid-open Patent No. 6-233877, of slidably disposing a looper thread hook for holding slidably the looper thread behind the looper of a double chain stitch sewing machine. This method comprises the steps of stopping the operation of the sewing machine once immediately before the sewing finish holding the looper thread by the looper thread hook, resuming the operation of the sewing machine in this state to sew one stitch, and cutting both needle threads and looper thread after the sewing. Then, as the sewing operator removes the cloth from the sewing machine while holding the looper thread by the looper thread hook, the entangling state of the needle thread and looper thread is varied so that the sewing thread may be hard to ravel.

Of the conventional methods for preventing thread from raveling, however, in the above methods (a) and (b), raveling of the sewing thread from the sewn end is not prevented securely. In the method (c), a long end of the cut thread hangs loose from the cloth, and the appearance of the sewn product is poor, or to improve the appearance, the manual labor of clipping the loose end of the thread off the cloth after finishing the sewing process is required.

SUMMARY OF THE INVENTION

The present invention is presented in the light of the above prior art, and it is hence an object thereof to provide a method for preventing a seam from raveling in a double chain stitch sewing machine capable of obtaining sewn products of high quality and good appearance, for securely preventing the sewing thread from raveling from the sewn end of double chain stitch formed in the cloth by a double chain stitch sewing machine, while shortening the thread end consecutive to the sewn end, and an apparatus used in such a method.

To achieve this object, the present invention provides a method for preventing a seam from raveling in a double chain stitch sewing machine having at least one needle moving vertically through which a needle thread is passed, and a looper through which a looper thread is passed for forming a double chain stitch by collaboration of the looper thread and the needle thread, while moving forward and backward between a forward position and a backward position across the needle. The method comprises the steps of: hooking and engaging a looper thread consecutive to the looper from a cloth by the engaging means when the looper is in an advanced state to the forward position near the sewing end point; cutting off the looper thread hooked and engaged on the engaging means at its engaging portion; cutting off a needle thread loop consecutive to the needle from the cloth through the looper at a position between the cloth and the looper in a state of the looper advanced again from the backward position to the forward position as the sewing machine is driven; and pulling out an end of a cut looper thread left over at the looper side from a final needle thread loop formed in the cloth.

In addition, the present invention presents a method for preventing a seam from raveling in a double chain stitch sewing machine having at least one needle moving vertically through which a needle thread is passed, and a looper through which a looper thread is passed for forming a double chain stitch by collaboration of the looper thread and the needle thread, while moving forward and backward between a forward position and a backward position across the needle. The method comprises the steps of: hooking and engaging a looper thread consecutive to the looper from a cloth by the engaging means when the looper is in an advanced state to the forward position near the sewing end point; cutting off the looper thread hooked and engaged on the engaging means in a state of the looper moved backward to the backward position from the forward position as the sewing machine is driven; and cutting off a needle thread loop consecutive to the needle from the cloth through the looper at a position between the cloth and the looper in a state of the looper advanced again from the backward position to the forward position as the sewing machine is driven.

Furthermore, the present invention presents a method for preventing a seam from raveling in a double chain stitch sewing machine having at least one needle moving vertically through which a needle thread is passed, and a looper through which a looper thread is passed for forming a double chain stitch by collaboration of the looper thread and the needle thread, while moving forward and backward between a forward position and backward position across the needle. The method comprises the steps of moving the engaging means into a triangular space of threads formed by a looper thread loop consecutive to the looper from a cloth and a needle thread loop engaged with the looper when the looper is in an advanced state to the forward position near the sewn end point; engaging and holding the looper thread loop by the engaging means as the sewing machine is driven; cutting off the looper thread loop held in the engaging means; and cutting off a needle thread loop engaged with the looper in a state of the looper advanced again to the forward position.

The present invention presents an apparatus for preventing a seam from raveling in a double chain stitch sewing machine having a needle drop point disposed in a sewing machine bed, at least one needle moving vertically through which a needle thread is passed, and a looper through which a looper thread is passed for forming a double chain stitch by collaboration of the looper thread and the needle thread, while moving forward and backward between a forward position and a backward position across the needle. The apparatus comprises: looper thread engaging means for engaging a looper thread between the needle drop point and a leading end of the looper at the forward position; a looper thread cutter for cutting off the looper thread engaged with the looper thread engaging means in its engaging position; needle thread engaging means for engaging a needle thread loop consecutive to the needle from a cloth through the looper at a position between the cloth and the looper; a needle thread cutter for cutting off the needle thread engaged with the needle thread engaging means in its engaging portion; and looper thread pulling means for pulling out an end portion of a cut looper thread left over at the looper side from a final needle thread loop formed in the cloth.

In addition, the present invention presents an apparatus for preventing a seam from raveling in a double chain stitch sewing machine having at least one needle moving vertically through which a needle thread is passed, and a looper through which a looper thread is passed for forming a double chain stitch by collaboration of the looper thread and the needle thread, while moving forward and backward between a forward position and a backward position across the needle. The apparatus comprises: looper thread engaging means for engaging and holding a looper thread loop by moving into a triangular space of threads formed by the looper thread loop consecutive to the looper from a cloth and a needle thread loop engaged with the looper when the looper is in an advanced state to the forward position; a looper thread cutter for cutting off the looper thread loop held in the engaging means; and a needle thread cutter for cutting off a needle thread loop engaged with the looper in a state of the looper advanced again to the forward position.

According to the present invention having such features, when approaching the end of sewing for forming a double chain stitch in a cloth by a needle thread passed through a needle and a looper thread passed through a looper, in the state of the looper thread consecutive to the looper from the cloth being hooked and engaged on the engaging means, the looper thread is cut off at its engaging portion, and the needle thread loop consecutive to the needle from the cloth through the looper is cut off between the cloth and looper, so that the looper thread consecutive to the sewing end of the cloth is in a discontinuous state. Moreover, the end portion of the looper thread left over at the looper side by the cutting off is pulled out of the final needle thread loop formed in the cloth. Therefore, the looper thread remaining in the loop state at the sewing end of cloth cannot be pulled out, and the looper thread loop does not ravel sequentially from the needle thread loop at the end of sewing, so that raveling can be securely prevented. Moreover, since the looper thread end consecutive to the sewing end of the cloth is cut short, it does not require manual labor of cutting off the looper thread end after sewing, so that sewn products of high quality and good appearance can be obtained efficiently.

Other objects and effects of the present invention will be better understood from the following description of the various embodiments taken in conjunction with the accompanying drawings.

BRIEF DESCRIPTION OF THE DRAWINGS

FIG. 22 is a magnified perspective view showing a fourth operation state of essential parts at the end of sewing in the third embodiment.

FIG. 23 is a magnified perspective view showing a fifth operation state of essential parts at the end of sewing in the third embodiment.

DESCRIPTION OF THE PREFERRED EMBODIMENTS OF THE INVENTION

Figure 1:
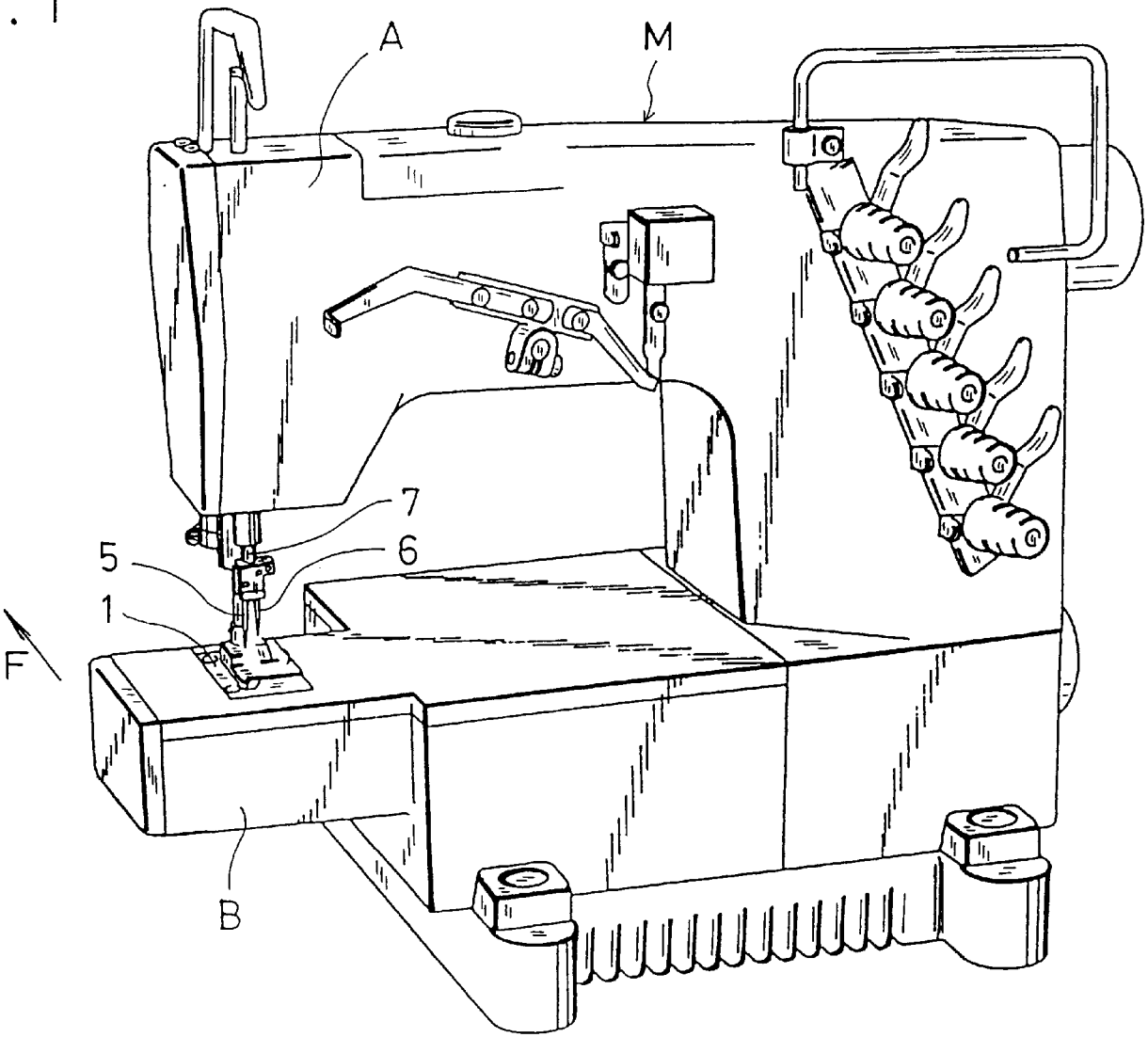
FIG. 1 is a general perspective view of a double chain stitch sewing machine according to the present invention.

Referring now to the drawings, preferred embodiments of the present invention are described below.

FIG. 1 shows a double chain stitch sewing machine M according to the present invention. A vertically moving needle bar 7 is provided in an arm A of the double chain stitch sewing machine M. A cylinder bed B of the double chain stitch sewing machine M comprises a feed dog shown in FIG. 2 for feeding a cloth in the direction of arrow F by moving in four directions vertically and longitudinally, a looper (not shown) moving in a direction orthogonal to the cloth feed direction F, and a throat plate 1 fixed by a screw. At the leading end of the needle bar 7, a left needle 5 and a right needle 6 are provided which move vertically through a needle hole (needle drop point) penetrating through the throat plate.

Figure 2:
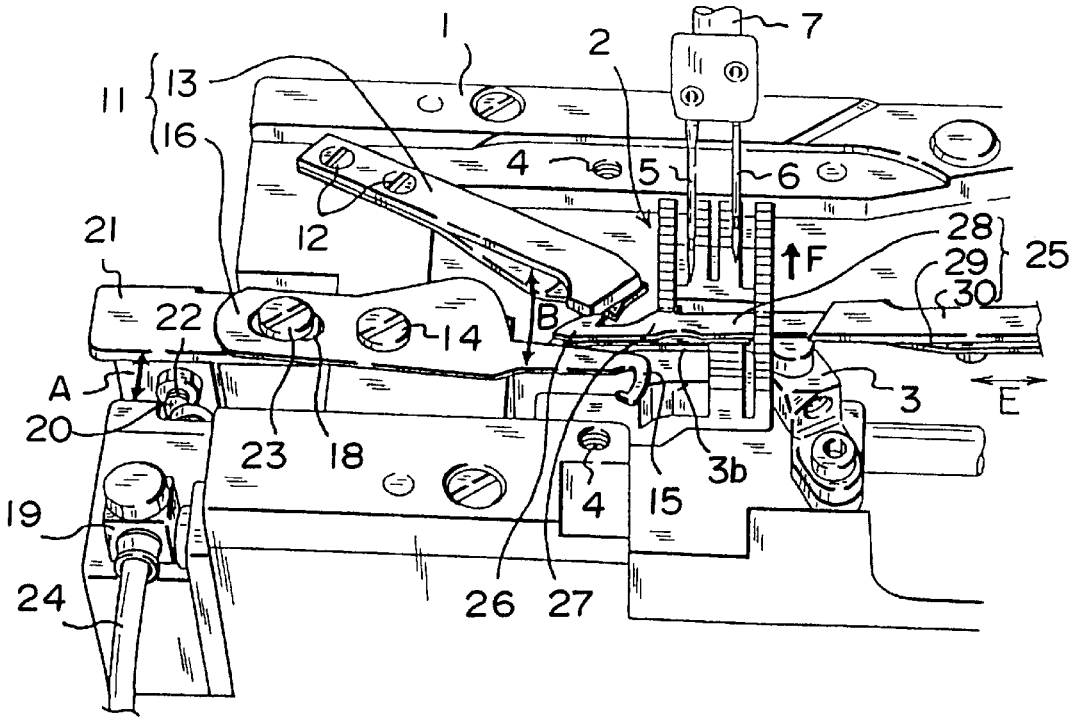
FIG. 2 is a perspective view of essential parts of the same sewing machine.
Figure 3:
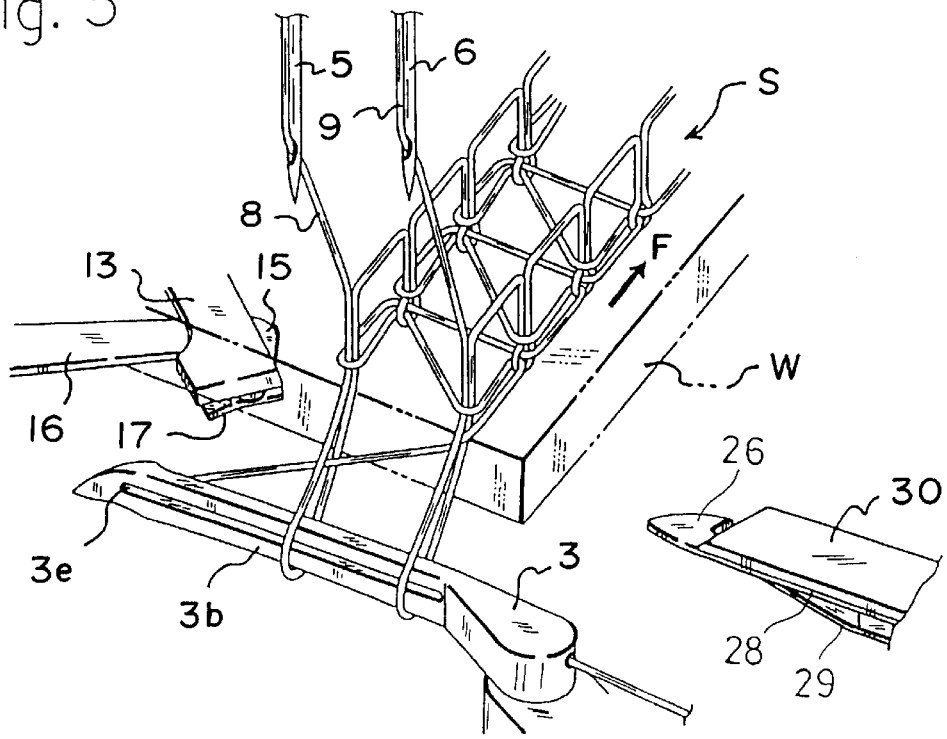
FIG. 3 is a magnified perspective view showing a first operation state of essential parts at the end of sewing in a first embodiment using the same sewing machine.

FIG. 2 is a magnified view of the cylinder bed B of the double chain stitch sewing machine M, which comprises the feed dog 2 for feeding the cloth in the direction of arrow F by moving in four directions vertically and longitudinally, the looper 3 for moving elliptically (oscillating) in the lateral and longitudinal direction orthogonally to the cloth feed direction F, and a screw hole 4 for fixing the throat plate 1 shown in FIG. 1. The left and right needles 5, 6 move vertically along with the vertical motion of the needle bar 7, and the looper 3 moves elliptically, laterally and longitudinally, from the right side of the parallel direction of the needles 5, 6. They collaborate, and form a double chain stitch S in the cloth W with needle threads 8, 9 and a looper thread 10 as shown in FIG. 3 to FIG. 9, or FIG. 10.

At the left side of the needle drop point in the sewing machine bed B, that is, at the left side of the vertical moving position of the left and right needles 5, 6, a looper thread cutter 11 is disposed. The looper thread cutter 11 comprises a first receiving knife 13 extending to the vicinity of the needle drop point along the lower side of the throat plate 1, being fixed to the rear part of the cylinder bed B screws 12, a first hook knife 16 rotatably fitted to the slightly front side of the cylinder bed B by a step screw 14, and having a hook 15 formed as looper thread engaging means at its leading end, and a pressing spring 17 for pressing the hook 15 to the lower side of the receiving knife 13 in a cutting operation. A slot 18 is formed at the rear end of the first hook knife 16 of the looper thread cutter 11.

At the left end of the cylinder bed B, an air cylinder 19 is provided as a forward and backward drive mechanism, and an operation piece 21 is fixed to a piston rod 20 of the air cylinder 19 so as to be adjustable in its position through a screw 22. A pin 23 provided in the operation piece 21 is fitted into the slot 18 formed in the first hook knife 16. The piston rod 20 is driven forward and backward in the direction of arrow A by an air pressure supplied into the air cylinder 19 through a pipe 24 from a high pressure air source such as a compressor (not shown). The first hook knife 16 is rotated in the direction of arrow B about the step screw 14 through the operation piece 21.

At the right side of the needle drop point in the cylinder bed B, a needle thread cutter 25 is provided. The needle thread cutter 25 comprises a second hook knife 28 moving reciprocally back and forth in the lateral direction along the upper side of the blade portion 3*b* of the looper 3, having two hooks 26, 27 formed at its leading end, and second receiving knife 30 pressed against the second hook knife 28 through a pressing spring 29, being provided at a backward position of the hook knife 28. The second hook knife 28 of the needle thread cutter 25 is also driven back and forth in the direction of arrow E by a forward and backward drive mechanism such as an air cylinder or solenoid not shown in the drawing.

In this construction of a first embodiment of the apparatus for preventing a seam from raveling in the double chain stitch sewing machine, a raveling preventing operation of the sewing thread at the end of a sewing operation will be described while referring to FIG. 2 through FIG. 9.

Figure 4:
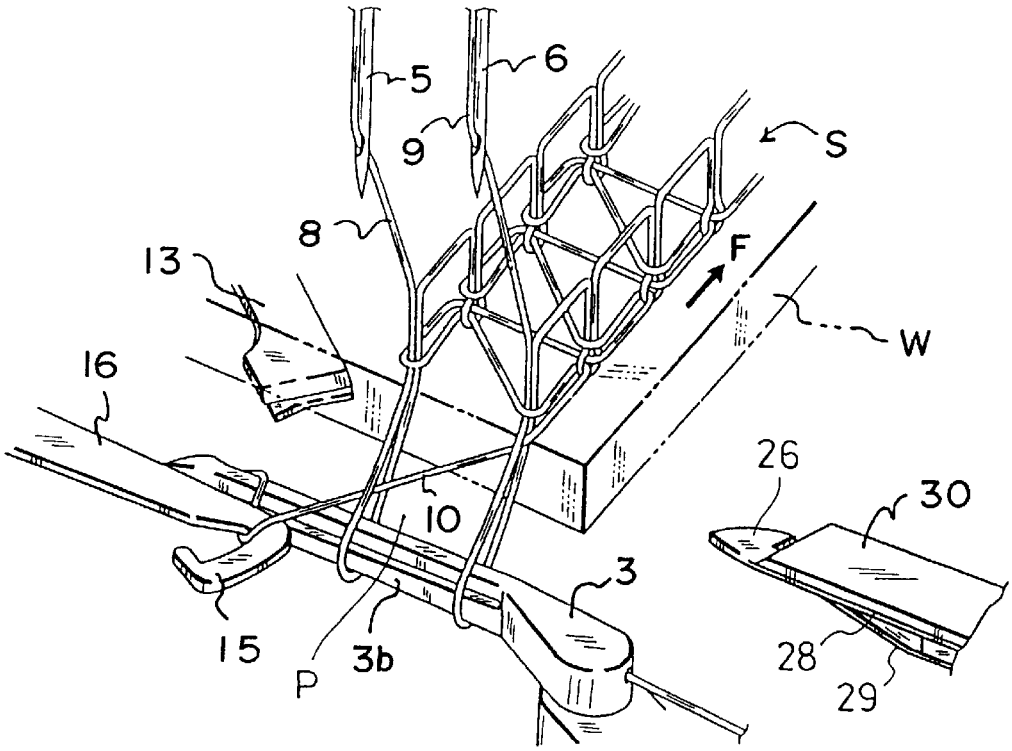
FIG. 4 is a magnified perspective view showing a second operation state of essential parts at the end of sewing in the first embodiment.

As shown in FIG. 2, the cloth W set on the throat plate 1 is fed in the direction of arrow F by the feed dog 2. In the cloth W, a double chain stitch S as indicated by the stitch symbol 406, noted above, is formed by the needle threads 8, 9 and the looper thread 10 passed through the left and right needles 5, 6 and the looper 3, respectively. Near the end point of the sewing, where the needles 5, 6 ascend nearly to the top dead center, and the looper 3 is nearly at the left dead center, that is, the forward position, when the air cylinder 19 is operated and the first hook knife 16 of the looper thread cutter 11 is rotated in the clockwise direction, the hook 15 of the first hook knife 16 moves across to the front side of the looper 3 above the blade portion 3*b* from behind the looper 3, between the eyelet 3*e* and the left needle 5, and is, as shown in FIG. 4, hooked and engaged with the looper thread 10 consecutive to the eyelet 3*e* from the cloth W.

Figure 5:
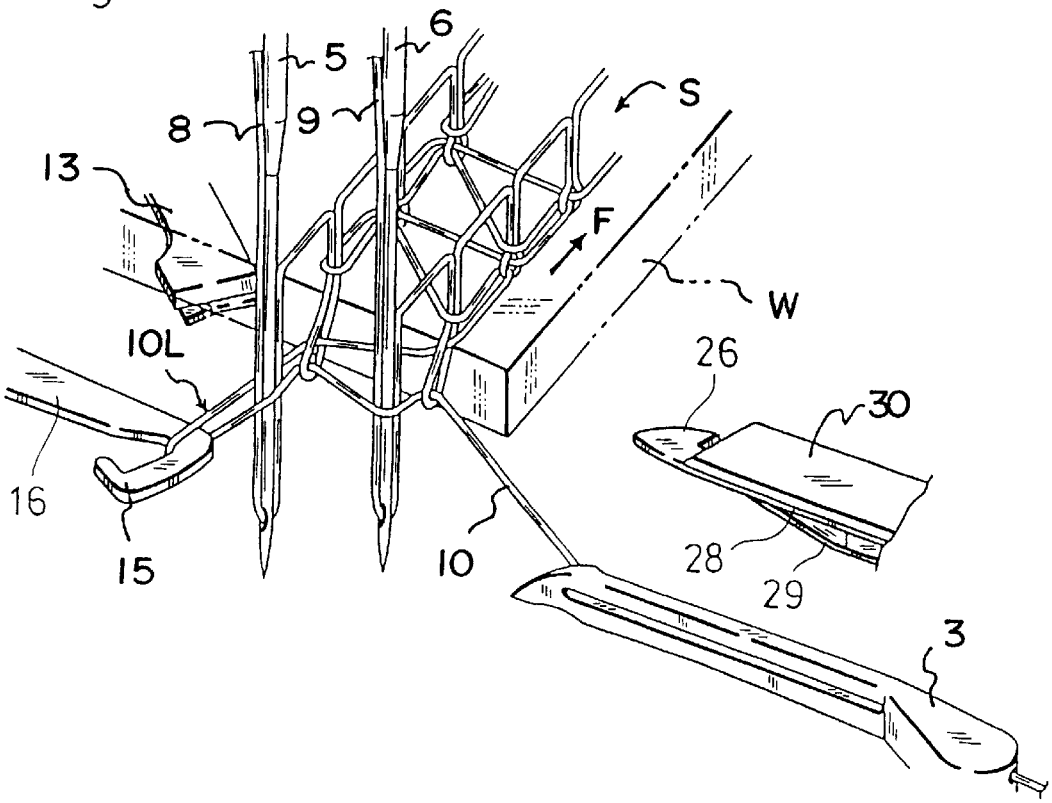
FIG. 5 is a magnified perspective view showing a third operation state of essential parts at the end of sewing in the first embodiment.
Figure 6:
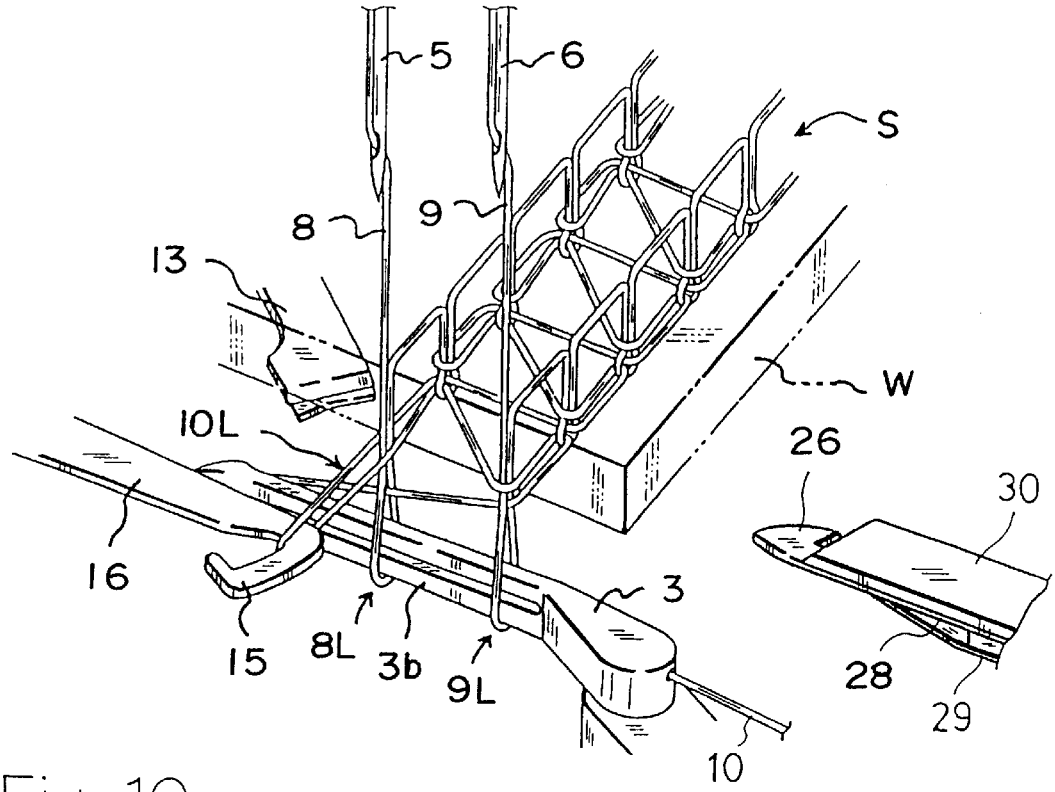
FIG. 6 is a magnified perspective view showing a fourth operation state of essential parts at the end of sewing in the first embodiment.

In succession, the left and right needles 5, 6 fall into a triangular space of threads formed by the looper thread 120, blade portion 3*b*, and needle threads 8, 9, and the looper 3 moves to the right (backward position) along the front side of the needles 5, 6, and therefore, as shown in FIG. 5, the looper thread 10 is engaged with the hook 15 at the front side position from the left needle 5, so that a slightly long loop 10L is formed. As seen in FIG. 6, the looper 3 moves forward to the left (forward position) at the rear side of the needles 5, 6 through the right dead center, that is, the backward position, and captures the new needle thread loops 8L, 9L formed by the needles 5, 6 ascending through the bottom dead center. FIG. 6 shows the state of advancing almost one stitch from the state in FIG. 3. Herein, the long loop 10L of the looper thread 10 engaged with the hook 15 is kept in the engaged state slightly above the looper 3.

Figure 7:
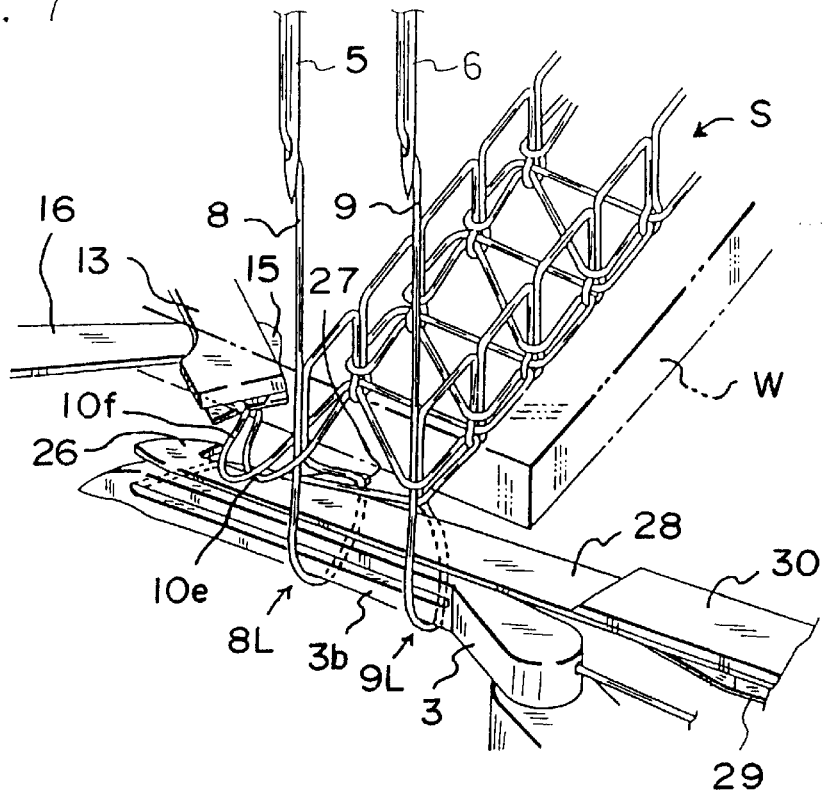
FIG. 7 is a magnified perspective view showing a fifth operation state of essential parts at the end of sewing in the first embodiment.

At this time, when the air cylinder 19 is operated, the first hook knife 16 in the looper thread cutter 11 is rotated in the counterclockwise direction, as shown in FIG. 7, and the hook, 15 of the first hook knife 16 returns to the downward position at the leading end of the receiving knife 13, the engaging portion of the looper thread 10 engaged with the hook 15 is cut off. Simultaneously with cutting of the looper thread, or slightly before or after it, the forward and backward drive mechanism such as an air cylinder or solenoid not shown in the drawing, is driven, and the second hook knife 28, the second receiving knife 30 and the pressing spring 29 in the needle thread cutter 25 are changed over to the action position, with the second hook knife 28 being moved forward to the left direction.

Figure 8:
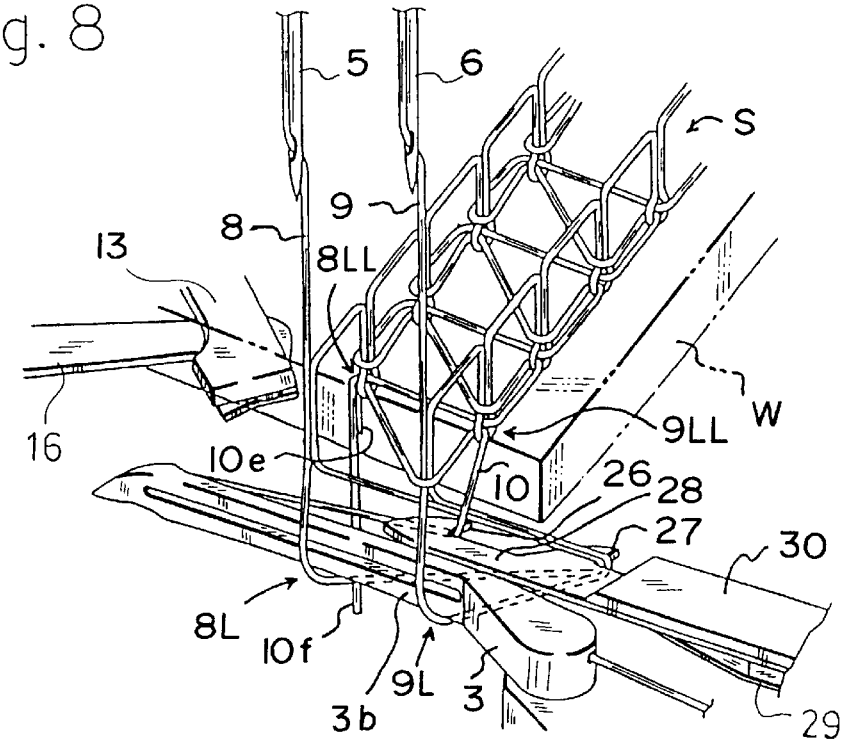
FIG. 8 is a magnified perspective view showing a sixth operation state of essential parts at the end of sewing in the first embodiment.
Figure 9:
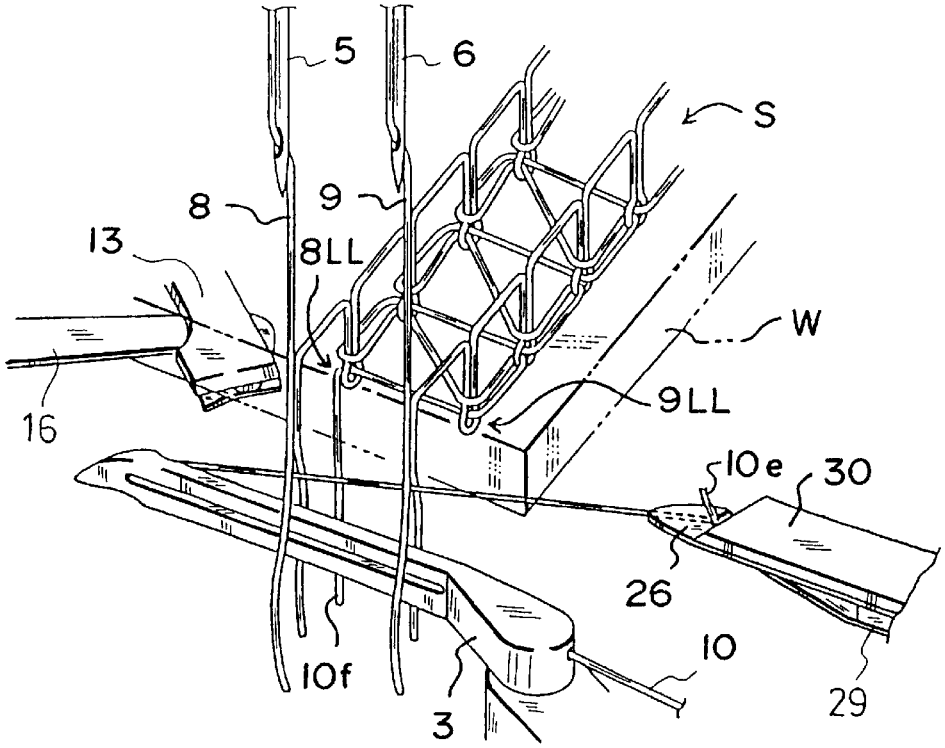
FIG. 9 is a magnified perspective view showing a seventh operation state of essential parts at the end of sewing in the first embodiment.

Next, the second hook knife 28 in the needle thread cutter 25 is moved backward to the right direction and, as shown in FIG. 8, the looper thread 10 consecutive to the looper 3 from the cloth W is hooked on the hook 26 at its leading end, and the two needle threads 8L, 9L extending downward from the blade portion 3*b* from the cloth W are hooked on the hook 27. In this way, while the threads 10, 8L, 9L are hooked on the hooks 26, 27, when the second hook knife 28 moves backward as shown in FIG. 8, the hook 27 reaches the receiving knife 30, so that the two needle threads 8L, 9L are cut off at the right side of the seam S. On the other hand, the looper thread 10 engaged with the hook 26 at the leading end is gradually bent along with the backward motion of the second hook knife 28, and when this bending is advanced to a certain extent, the cut thread end 10*e* of the side consecutive to the looper 3 of the cut-off looper thread 10 is pulled out to the right side through the final needle thread loops 8LL, 9LL formed in the cloth W. The side of the thread end 10*e* being pulled out at the point when the second hook knife 28, the second receiving knife 30 and the pressing spring 29 are changed over to the waiting position is, as shown in FIG. 9, elastically pinched and held between the front end of the hook 26 and the pressing spring 29.

In this way, both thread ends 10*e*, 10*f* of the cut-off looper thread 10 are not consecutive, and the thread end 10*f* of the looper thread 10 consecutive to the cloth W side is short, while the thread end 10*e* of the looper thread 10 left over at the looper 3 side and pulled out from the needle thread loops 8LL, 9LL at the end of sewing is elastically pinched and held between the hook 26 and pressing spring 29, so that raveling from the sewing end of the cloth W does not occur unless the thread end 10*f* consecutive to the cloth W side is pulled out from the needle thread loop 8LL at the left side of the sewing end point.

Figure 10:
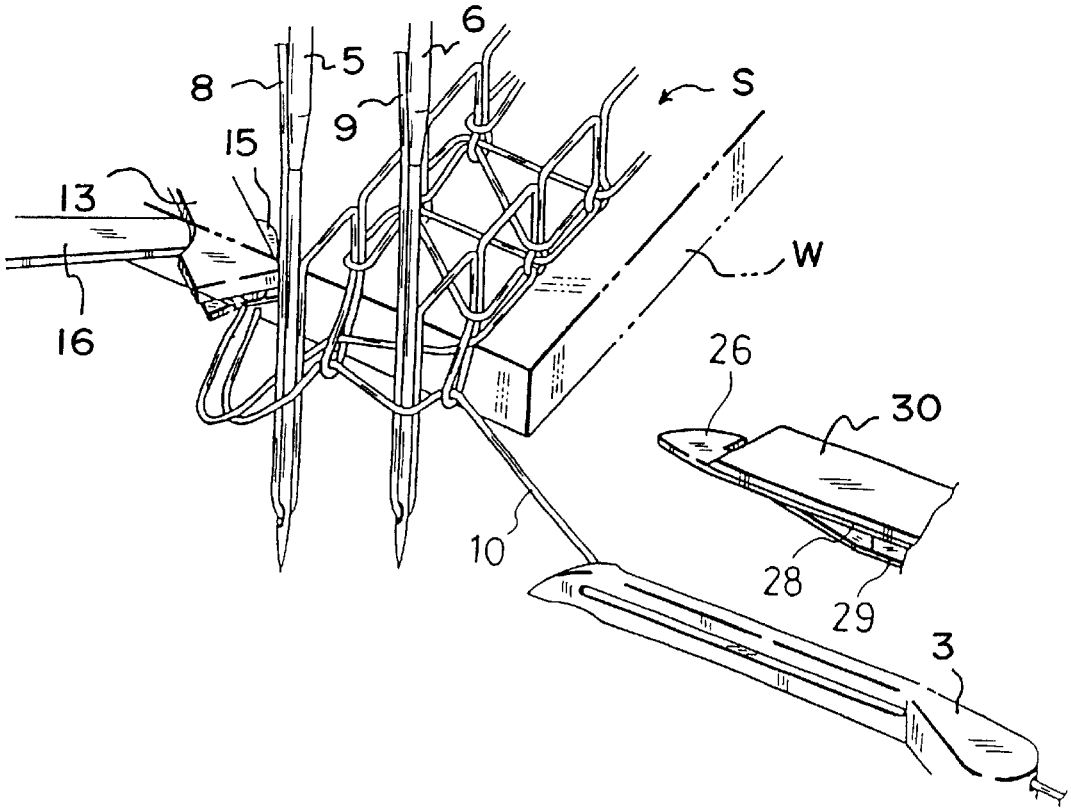
FIG. 10 is a magnified perspective view showing a modified example of operation state of essential parts at the end of sewing in the first embodiment.

In this first embodiment, the long loop 10L of the looper thread 10 hooked and engaged on the hook 15 of the first hook knife 16 is cut off when the hook 15 reaches the leading end lower position of the receiving knife 13 after the looper 3 captures new needle thread loops 8L, 9L as shown in FIG. 7. But this long loop 10L may be also cut off in the state of the backward position of the looper 3 as shown in FIG. 5 by driving the sewing machine for the portion of a half stitch from the forward position of the looper 3 shown in FIG. 4. That is, in the state of forming the long loop 10L of the looper thread 10, as shown in FIG. 10, the hook 15 is moved to the leading end lower position of the receiving knife 13 to cut off the engaging portion of the looper thread 10 engaged with the hook 15. After the looper 3 captures new needle thread loops 8L, 9L, the hooks 26, 27 disposed parallel to the leading end side of the second hook knife 28 is moved along the upper side of the blade portion 3*b* of the looper 3 and forward to the left side of the needle drop point as shown in FIG. 7. Thus, as in the first embodiment, occurrence of raveling from the sewing end of the cloth W can be prevented.

Incidentally, in the double chain stitch sewing machine used in the first embodiment, the backward position of the looper is at the right side of the needle drop point, but also in the double chain stitch sewing machine in which the backward position of the looper is at the left side of the needle drop point, by using the same looper thread cutter and needle thread cutter as in the first embodiment, raveling can be similarly prevented at the sewing end point of the cloth. The double chain stitch sewing machine used in the first embodiment comprises two needles, but only one needle may be enough. Hereinafter, in a second embodiment in which the backward position of the looper is at the left side of the needle drop point and the double chain stitch sewing machine has one needle only, the operation of preventing raveling of the sewing thread at the end of sewing is explained while referring to FIG. 11 to FIG. 18.

Figure 11:
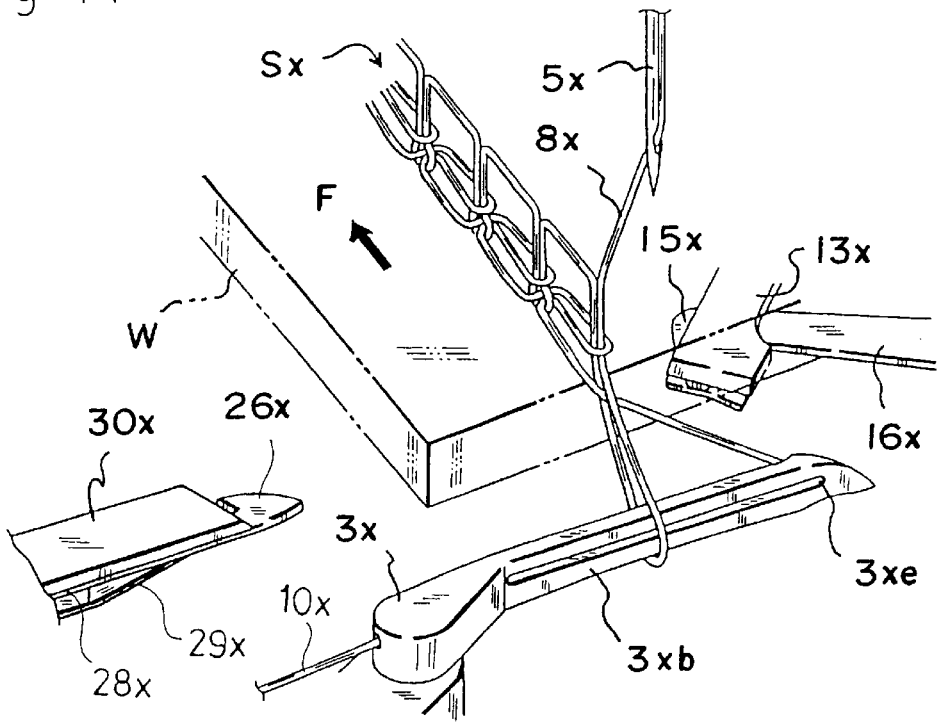
FIG. 11 is a magnified perspective view showing a first operation state of essential parts at the end of sewing in a second embodiment using a one-needle double chain stitch sewing machine.
Figure 12:
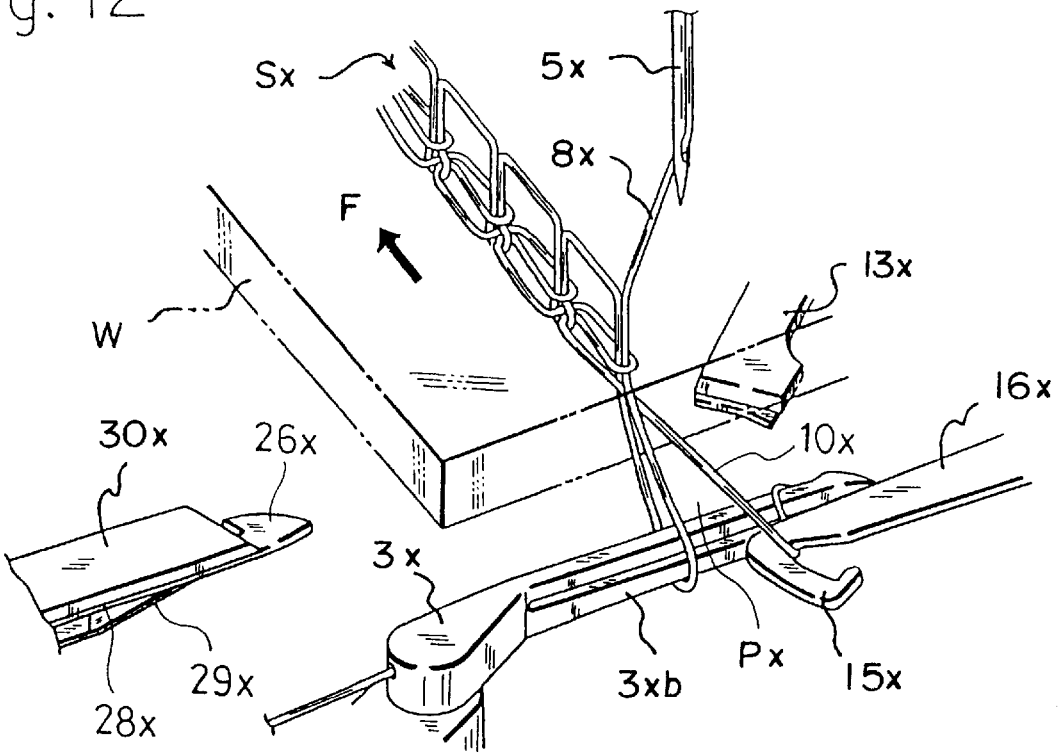
FIG. 12 is a magnified perspective view showing a second operation state of essential parts at the end of sewing in the second embodiment.
Figure 13:
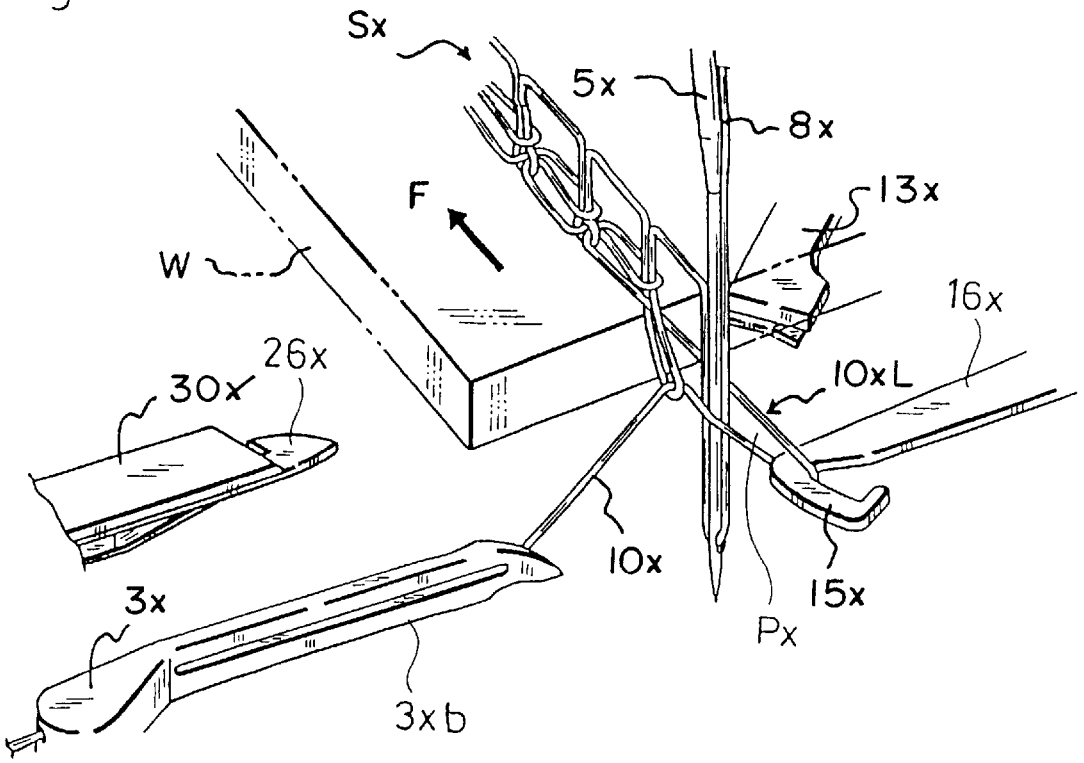
FIG. 13 is a magnified perspective view showing a third operation state of essential parts at the end of sewing in the second embodiment.

As shown in FIG. 11, in this sewing machine, too, the cloth W is fed in the direction of arrow F by the feed dog 2. In this cloth W, a seam Sx as indicated by the stitch symbol 401 is formed by needle thread 8*x* and looper thread 10*x* passed through a needle 5*x* and a looper 3*x*, respectively. Near the end point of sewing, where the needle 5*x* is near the top dead center, and the looper 3*x* is nearly at the right dead center, that is, the forward position, when the first hook knife 16*x* is turned in the counterclockwise direction, the hook 15*x* moves across to the front side above the blade portion 3*xb* of the looper 3*x*, from behind the looper 3*x*. By this move, the hook 15*x* hooks the looper thread 10*x* consecutive to the eyelet 3*xe* of the looper 3*x* from the cloth W as shown in FIG. 12.

Figure 14:
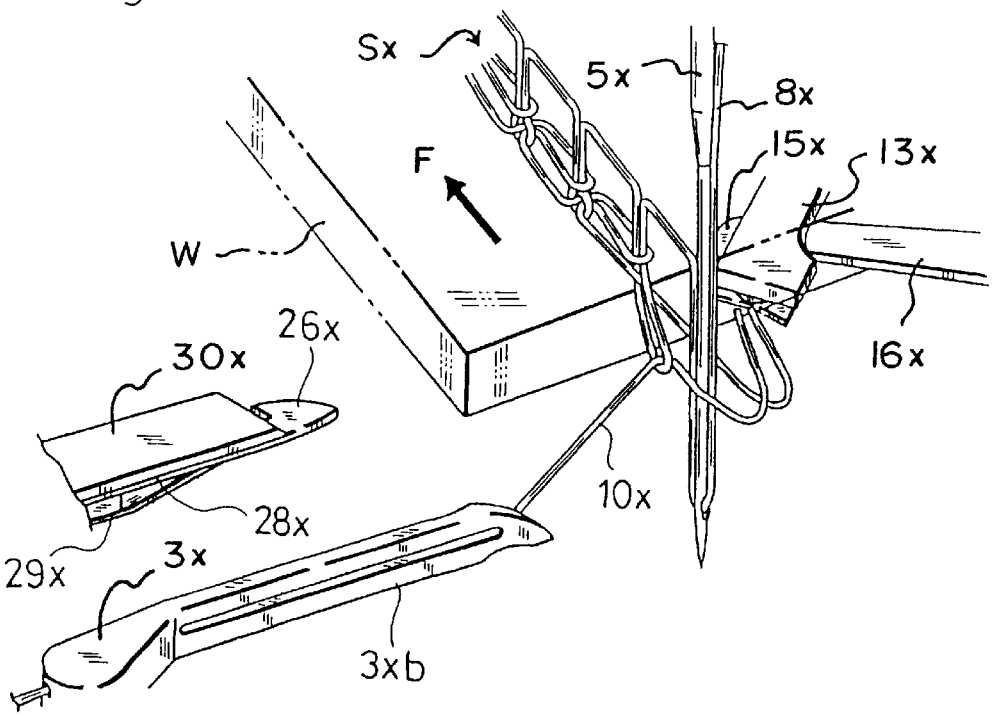
FIG. 14 is a magnified perspective view showing a fourth operation state of essential parts at the end of sewing in the second embodiment.

In succession, the needle 5*x* falls into a triangular space Px of threads formed by the looper thread 10*x*, blade portion 3*xb*, and needle thread 8*x*. Along with the descent of the needle 5*x*, the looper 3*x* moves to the left (backward position) along the front side of the needle 5*x*. The looper thread 10*x* engaged with the hook 15*x* at the front side position from the needle 5*x* forms a slightly long loop 10*x*L, as indicated by the backward position state of the looper 3*x* in FIG. 13 as the sewing machine is driven for a half stitch from the forward position of the looper 3*x* shown in FIG. 12. At this time, by operating the air cylinder (not shown), the first hook knife 16*x* is rotated in the clockwise direction as shown in FIG. 14. By the rotation of the first hook knife 16*x*, the hook 15*x* reaches the leading end lower position of the receiving knife 13*x* and cuts off the engaging portion of the looper thread 10*x* engaged with the hook 15*x*.

Figure 15:
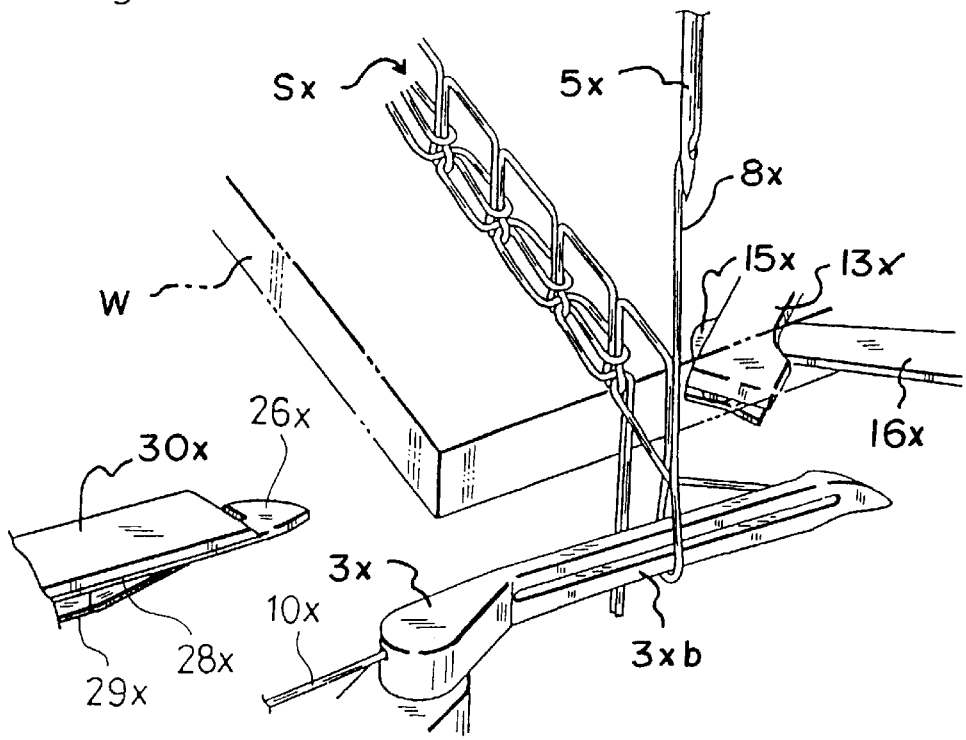
FIG. 15 is a magnified perspective view showing a fifth operation state of essential parts at the end of sewing in the second embodiment.
Figure 16:
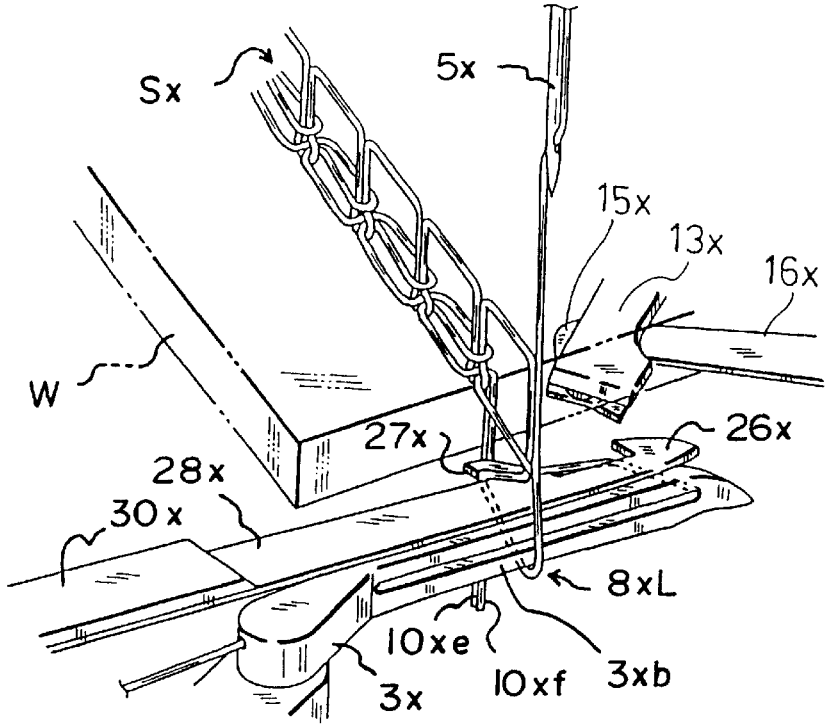
FIG. 16 is a magnified perspective view showing a sixth operation state of essential parts at the end of sewing in the second embodiment.
Figure 17:
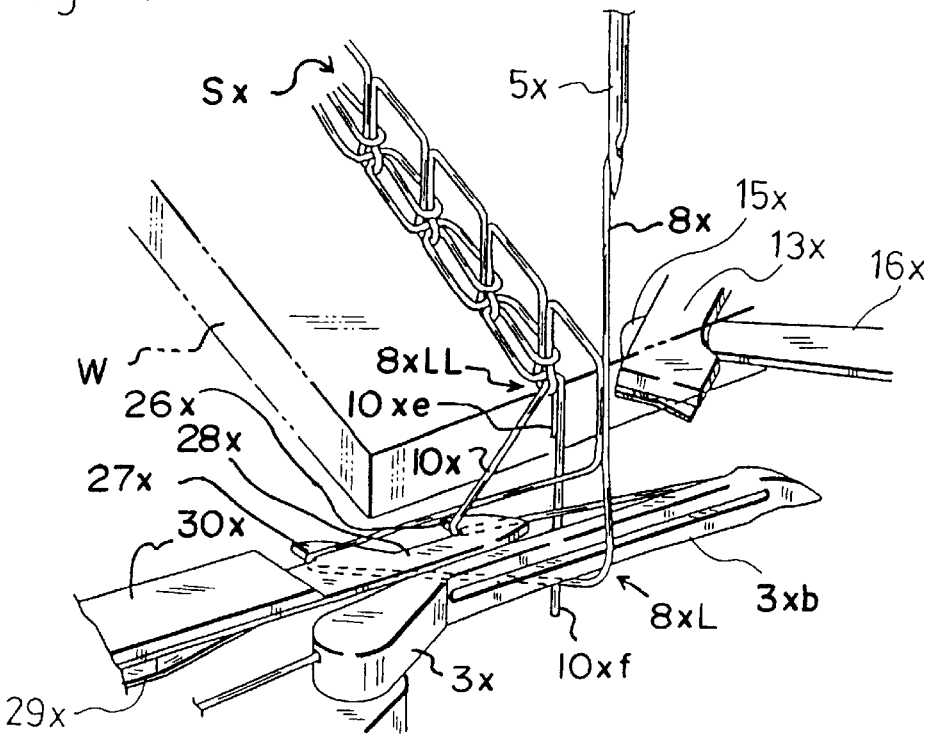
FIG. 17 is a magnified perspective view showing a seventh operation state of essential parts at the end of sewing in the second embodiment.

Then, the looper 3*x* moves forward to the right behind the needle 5*x* after the left dead center and captures, as shown in FIG. 15, a new needle thread loop 8*x*L formed by the needle 5*x* ascending past the bottom dead center. At this time, the second hook knife 28*x*, second receiving knife 30*x* and pressing spring 29*x* are changed over to the action position, and the second hook knife 28*x* is moved forward to the right direction. As a result, the hooks 26*x*, 27*x* move to the right side of the needle drop point along the upper side of the blade portion 3*xb* of the looper 3 as shown in FIG. 16. When the second hook knife 28*x* is moved backward to the left direction, the hook 26*x* hooks the looper thread 10*x* consecutive to the looper 3*x* from the cloth W, and the hook 27*x* hooks the needle thread loop 8*x* consecutive to the needle 5*x* through the blade portion 3*xb* of the looper 43*x* from the cloth W. The second hook knife 28*x* moves backward to the left as shown in FIG. 17, with the threads 10*x*, 8*x* hooked and engaged on the hooks 26*x*, 27*x*. By this backward motion, the needle thread loop 8*x*L engaged with the hook 28*x* is cut off when the hook 27*x* reaches the lower position of the second receiving knife 30*x*.

Figure 18:
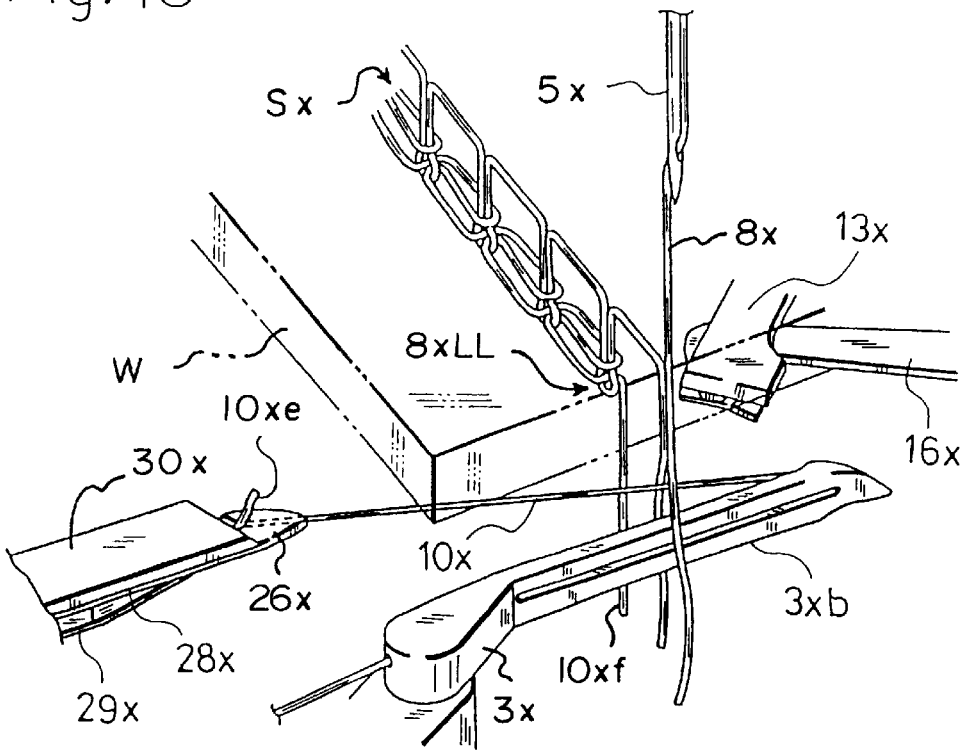
FIG. 18 is a magnified perspective view showing an eighth operation state of essential parts at the end of sewing in the second embodiment.

On the other hand, the looper thread 10*x* engaged with the hook 26*x* is gradually bent along with the backward motion of the second hook knife 28*x*. When this bending is advanced to a certain extent, the cut-off thread end 10*xe* is pulled out to the left side through the final needle thread loop 8*x*LL formed in the cloth W. When the second hook knife 28*x*, second receiving knife 30*x*, and pressing spring 29*x* are changed over to the waiting position, the side of the thread end 10*xe* being pulled out is held between the hook 26*x* and the pressing spring 29*x* as shown in FIG. 18. That is, the thread end 20*xf* of the looper thread 10 consecutive to the cloth W is short and left over, and the thread end 10*xe* of the looper thread 10 left over at the looper 3*x* side is pulled out from the final needle thread loop 8*x*LL. In this way, raveling from the sewing end of the cloth W does not occur unless the thread end 10*x*F of the cut-off looper thread 10 is pulled out from the final needle thread loop 8*x*LL.

In this second embodiment, details are not explained about driving of the sewing machine for one stitch or half stitch or controlling of the start of each cutter, but it is possible to employ known means regarding the rotation control device of a sewing machine motor and drive by a rotation signal detector provided on the sewing machine main shaft. Or if the leading end 10*xe* of the looper thread 10 being cut and held is too long, the hook 26*x* may be moved up to the second hook knife 28*x*, and this leading end 10*xe* may be cut off.

In a third embodiment using the same apparatus for preventing a seam form raveling in the double chain stitch sewing machine with the same construction used in the first embodiment as shown in FIG. 2, the operation of preventing raveling of sewing thread at the end of sewing is explained while referring to FIG. 19 to FIG. 26.

Figure 19:
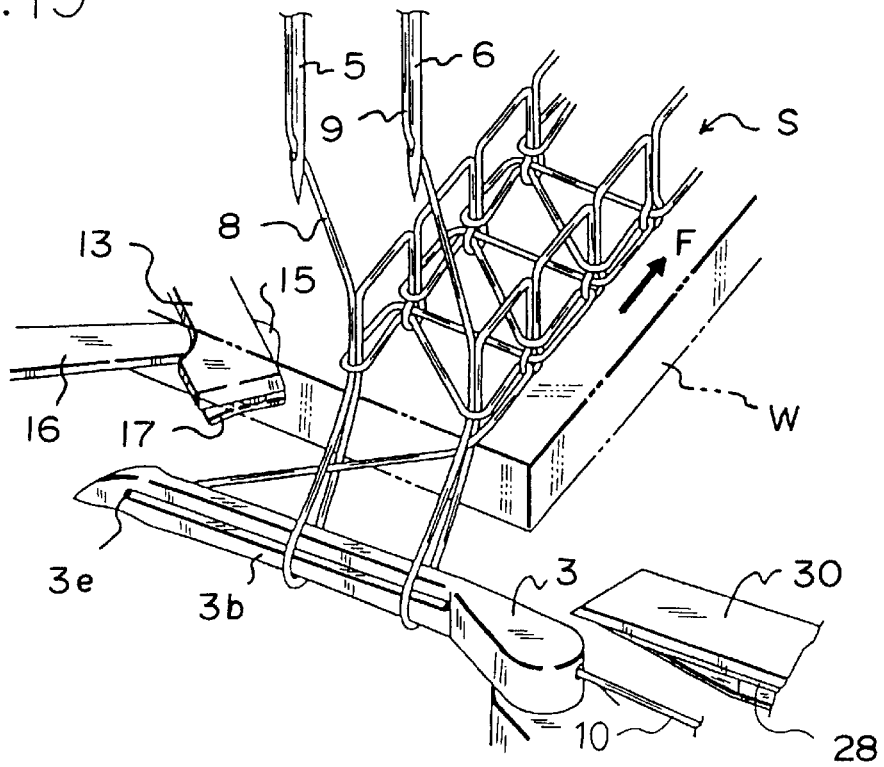
FIG. 19 is a magnified perspective view showing a first operation state of essential parts at the end of sewing in a third embodiment using the sewing machine in FIG. 2.
Figure 20:
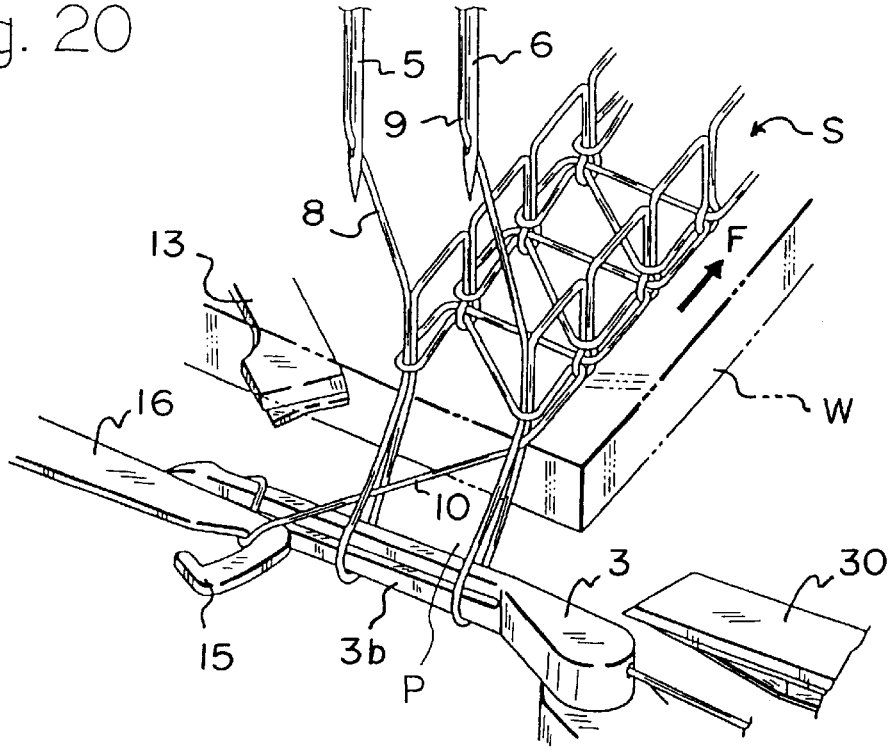
FIG. 20 is a magnified perspective view showing a second operation state of essential parts at the end of sewing in the third embodiment.
Figure 21:
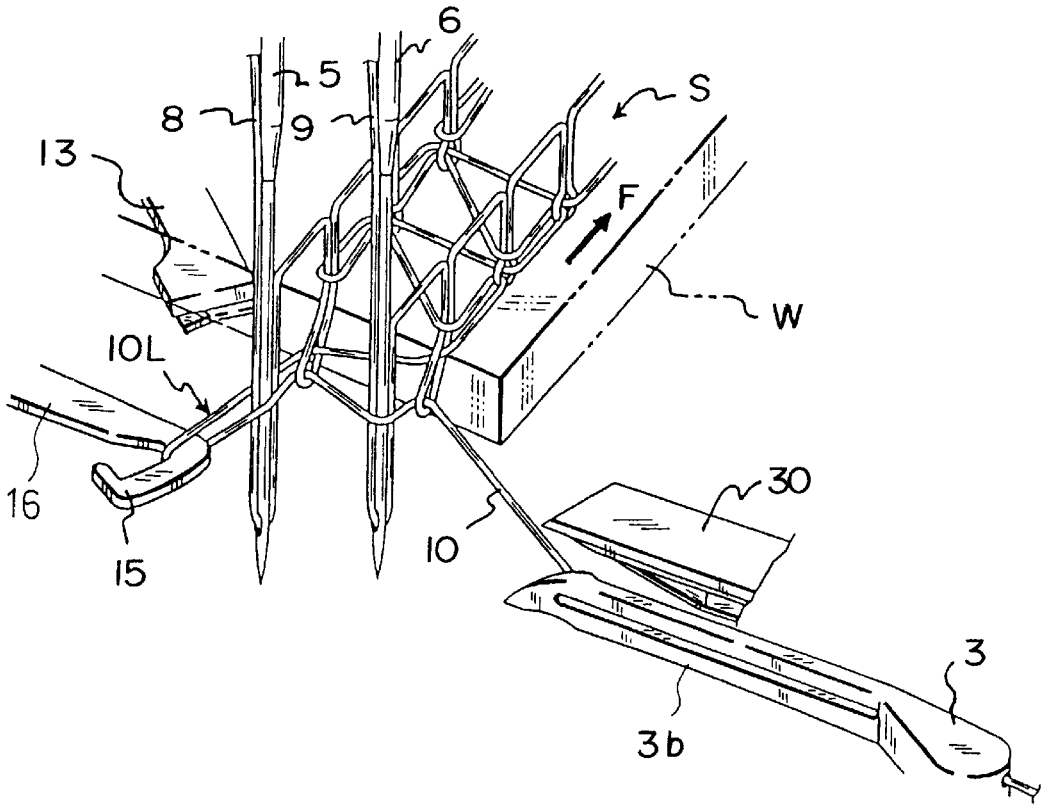
FIG. 21 is a magnified perspective view showing a third operation state of essential parts at the end of sewing in the third embodiment.

As shown in FIG. 19, the cloth W set on the throat plate 1 is fed in the direction of the arrow F by the feed dog 2. In this cloth W, a double chain stitch S as indicated by the stitch symbol 406 is formed by the needle threads 8, 9 and looper thread 10 passed through the left and right needles 5, 6 and looper 3, respectively. Near the end point of sewing, where the needles 5, 6 ascend nearly to the top dead center, and the looper 3 is nearly at the left dead center, that is, the forward position, when the air cylinder 19 is operated and the first hook knife 16 of the looper thread cutter 11 is rotated in the clockwise direction, the hook 15 at the leading end of the first hook knife 16 moves across to the front side above the blade portion 3*b*, from behind the looper 3, between the eyelet 3*e* and the left needle 5, and is, as shown in FIG. 20, hooked and engaged with the looper thread 10 consecutive to the eyelet 3*e* from the cloth W.

In succession, the left and right needles 5, 6 fall into a triangular space of threads formed by the looper thread 10, blade portion 3*b*, and needle threads 8, 9, and the looper 3 moves to the right (backward position) along the front side of the needles 5, 6. The looper thread 10 is, as shown in the backward position state of the looper in FIG. 21 by driving the sewing machine by a half stitch from the forward position of the looper 3 shown in FIG. 20, engaged with the hook 15 at the front side position from the left needle 5, so that a slightly long loop 10L is formed. At this time, when the air cylinder 19 is operated, and the first hook knife 16 in the looper thread cutter 11 is rotated in the counterclockwise direction as shown in FIG. 22 until the hook 15 returns to the leading end lower position of the receiving knife 13, the engaging portion of the looper thread 10 engaged with this hook 15 is cut off. The thread end 10*e* of the looper thread 10 left over at the looper 3 side by this cutting is held by the hook 15 and pressing spring 17, and the thread end 10*f* of the looper thread 10 consecutive to the cloth W side is drooping from the cloth W.

Figure 24:
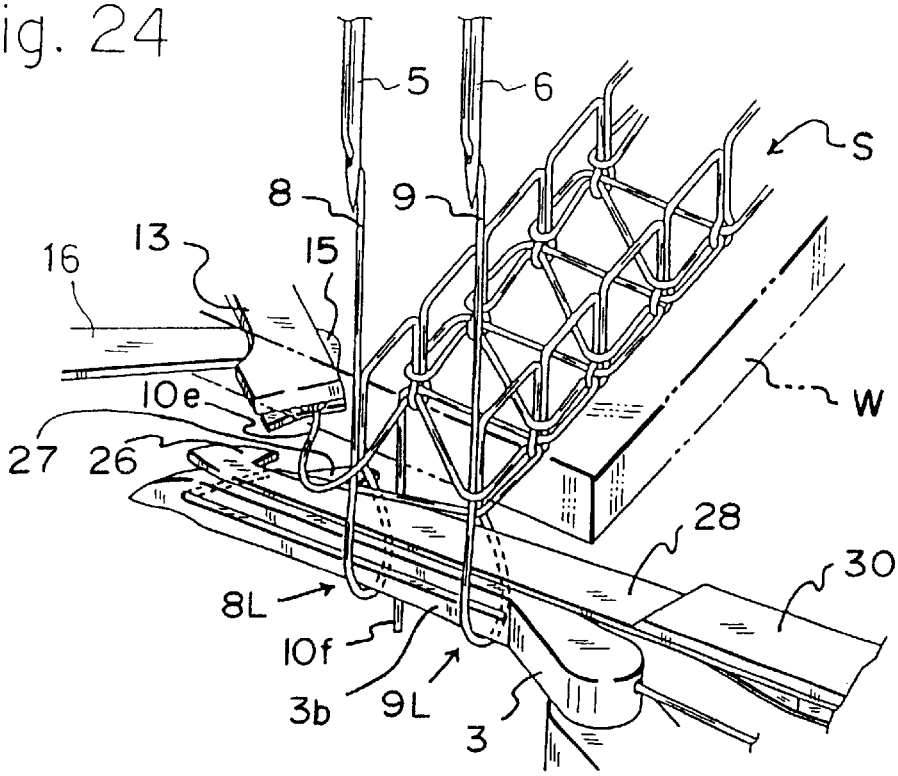
FIG. 24 is a magnified perspective view showing a sixth operation state of essential parts at the end of sewing in the third embodiment.

Then, the looper 3 moves forward to the left at the rear side of the needles 5, 6 through the right dead center, and captures new needle thread loops 8L, 9L formed by the needles 5, 6 ascending through the bottom dead center as shown in FIG. 23. Consequently, the forward and backward drive mechanism such as an air cylinder and a solenoid, not shown in the drawing, is driven, and the second hook knife 28, second receiving knife 30 and pressing spring 29 in the needle thread cutter 25 are changed over to the action position. The second hook knife 28 is moved forward to the left, and the hooks 26, 27 disposed parallel to its end moves to the left side of the needle drop point along the upper side of the blade portion 3*b* as shown in FIG. 24.

Figure 25:
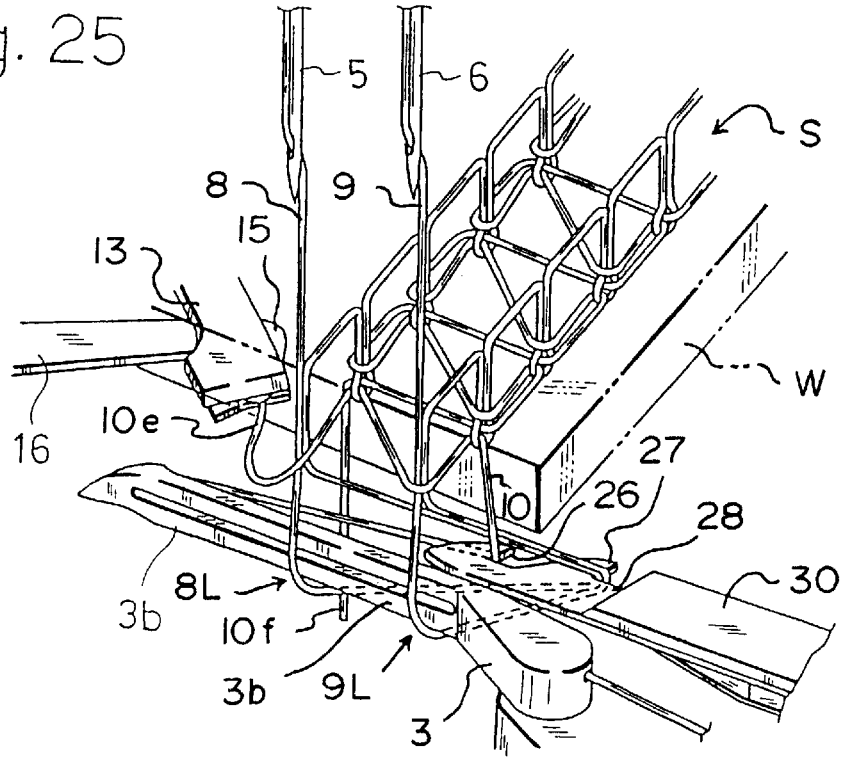
FIG. 25 is a magnified perspective view showing a seventh operation state of essential parts at the end of sewing in the third embodiment.
Figure 26:
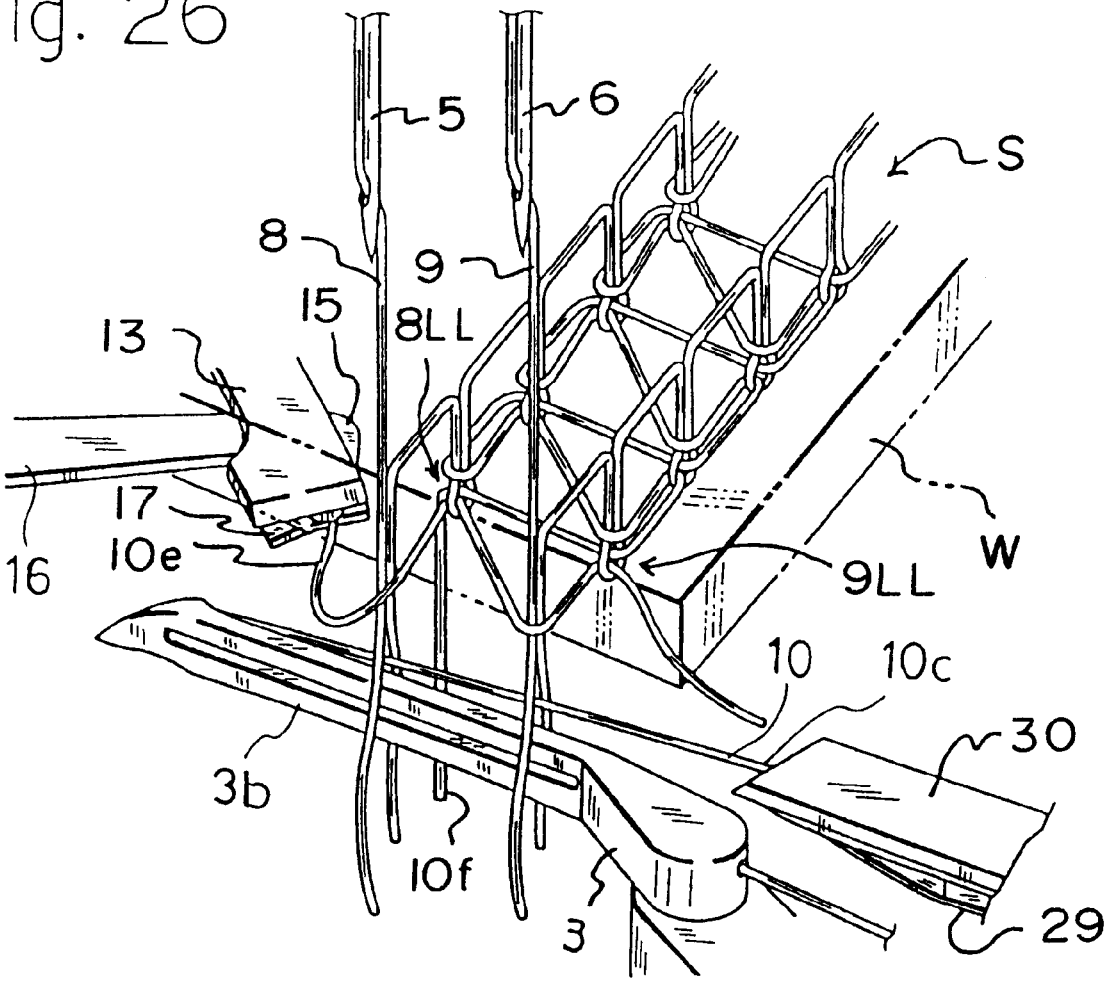
FIG. 26 is a magnified perspective view showing an eighth operation state of essential parts at the end of sewing in the third embodiment.

Next, the second hook knife 28 in the needle thread cutter 25 is moved backward to the right direction and, as shown in FIG. 25, the looper thread 10 consecutive to the looper 3 from the cloth W is hooked on the hook 26 at its leading end, and the two needle threads 8L, 9L consecutive to the needles 5, 6 through the blade portion 3*b* of the looper 3 from the cloth W are hooked on the hook 27. In this way, while the threads 10, 8L, 9L are hooked on the hooks 26, 27, when the second hook knife 28 moves backward as shown in FIG. 25, the hooks 26, 27 reach the receiving knife 30, so that the two needle threads 8L, 9L and looper thread 10 are cut off at the right side of the seam S. At this time, the cut thread end 10*c* at the side consecutive to the looper 3 of the looper thread 10 engaged with the hook 26 is elastically pinched and held between the hook 26 of the second hook knife 28 and the pressing spring 29 as shown in FIG. 26.

Both thread ends 10*e*, 10*f* being thus cut off are not consecutive, and when the cloth W is dismounted from the sewing machine, the thread end 10*e* side held by the hook 165 and pressing spring 17 is pulled out from the needle thread loops 8LL, 9LL at the end of sewing, while the thread end 10*f* is left over at the cloth W side and is not pulled out. That is, the thread end 10*f* of the looper thread 10 consecutive to the cloth W is short and left over, and the thread end 10*e* side of the cut-off looper thread 10 is pulled out from the final needle thread loops 8LL, 9LL at the end of sewing.

Therefore, raveling from the sewing end of the cloth W does not occur unless the thread end 10*f* of the cut-off looper thread 10 is pulled out from the needle thread loop 8LL at the sewing end point.

Moreover, the thread end 10*e* held between the hook 15 and pressing spring 17 is released when the first hook knife 16 is next turned, and it may be removed at that time by a thread chip suction device or the like. Although details are not explained about driving of the sewing machine for a half stitch or controlling of the start of each cutter, it is possible to employ known means regarding the rotation control device of a sewing machine motor and drive by a rotation signal detector provided on the sewing machine main shaft.

As the apparatus for preventing a seam from raveling in the double chain stitch sewing machine shown in FIG. 1, an apparatus for preventing a seam from raveling in a different construction from those shown in the first to third embodiments is described below while referring to FIG. 27 to FIG. 30.

Figure 27:
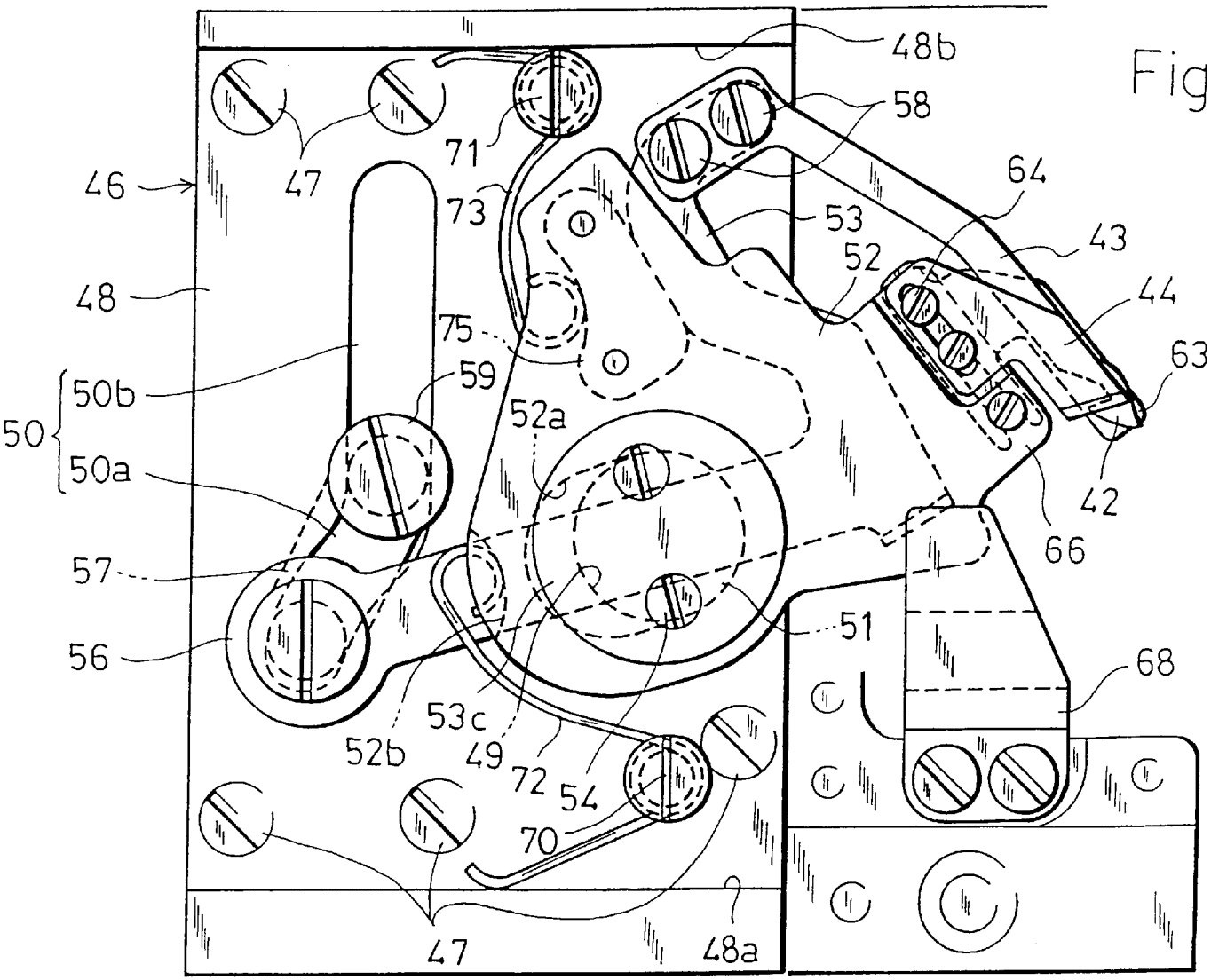
FIG. 27 is a plan view in non-operation state of looper thread cutter which is an essential part of the apparatus for preventing a seam from raveling in the double chain stitch sewing machine in FIG. 1.
Figure 28:
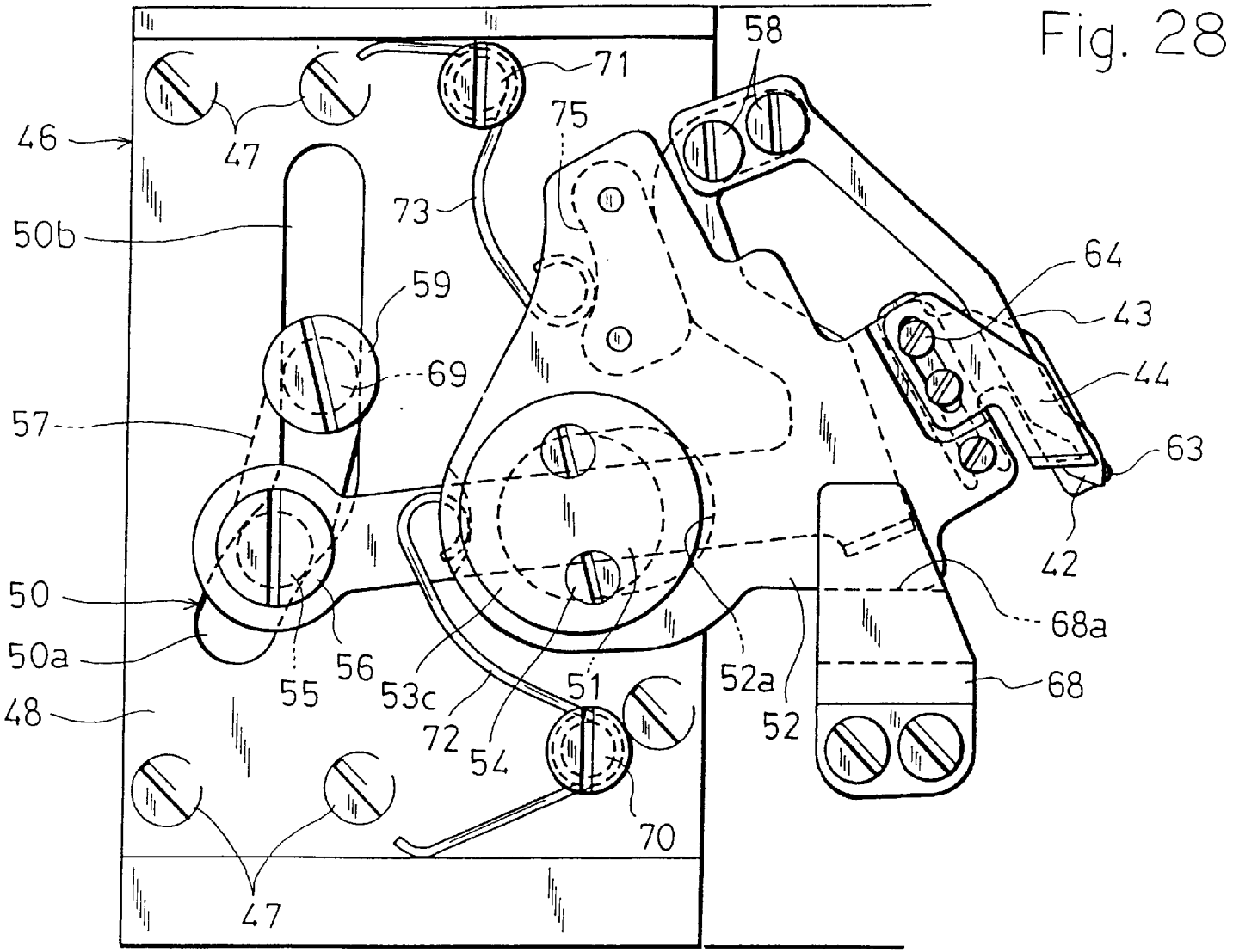
FIG. 28 is a plan view in an operation state of the same looper thread cutter.
Figure 29:
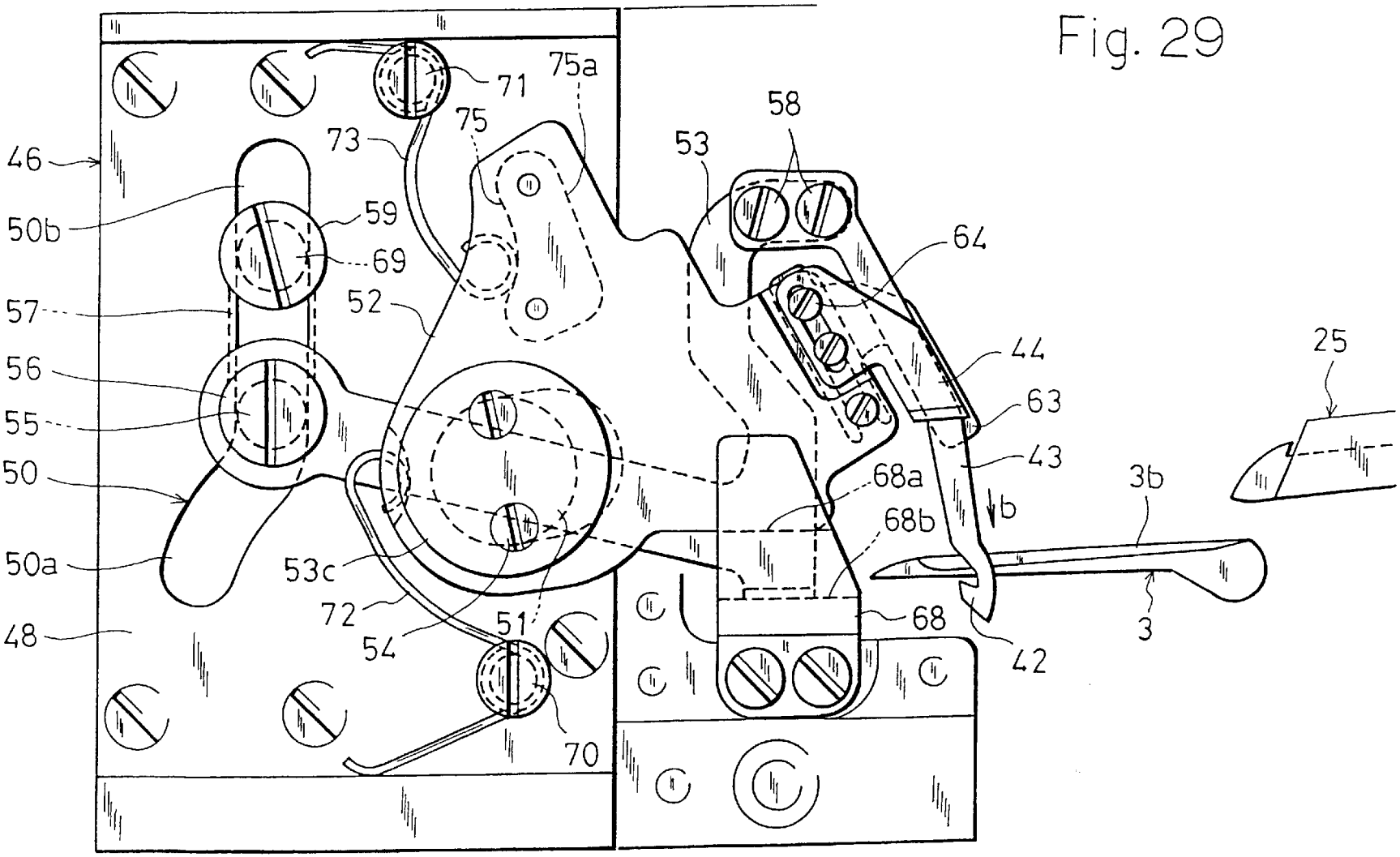
FIG. 29 is a plan view in an operation state of the same looper thread cutter.

The essential parts of this apparatus for preventing a seam from raveling are shown in FIG. 27 to FIG. 29. A looper thread cutter 41 is disposed at the left side of the throat plate 1 (see FIG. 1), that is, at the leading end of the cylinder bed B. The looper thread cutter 41 comprises a hook knife (looper thread engaging means) 43 having a hook 42 formed at its leading end, a receiving knife 44 for cutting off the looper thread 10 by collaboration with the hook knife 43, and a pressing spring 45 for pressing the hook knife 43 to the lower side of the receiving knife 44. A rotary oscillating mechanism 46 (described later) for moving the members 43, 44, 45 is also provided.

Figure 30:
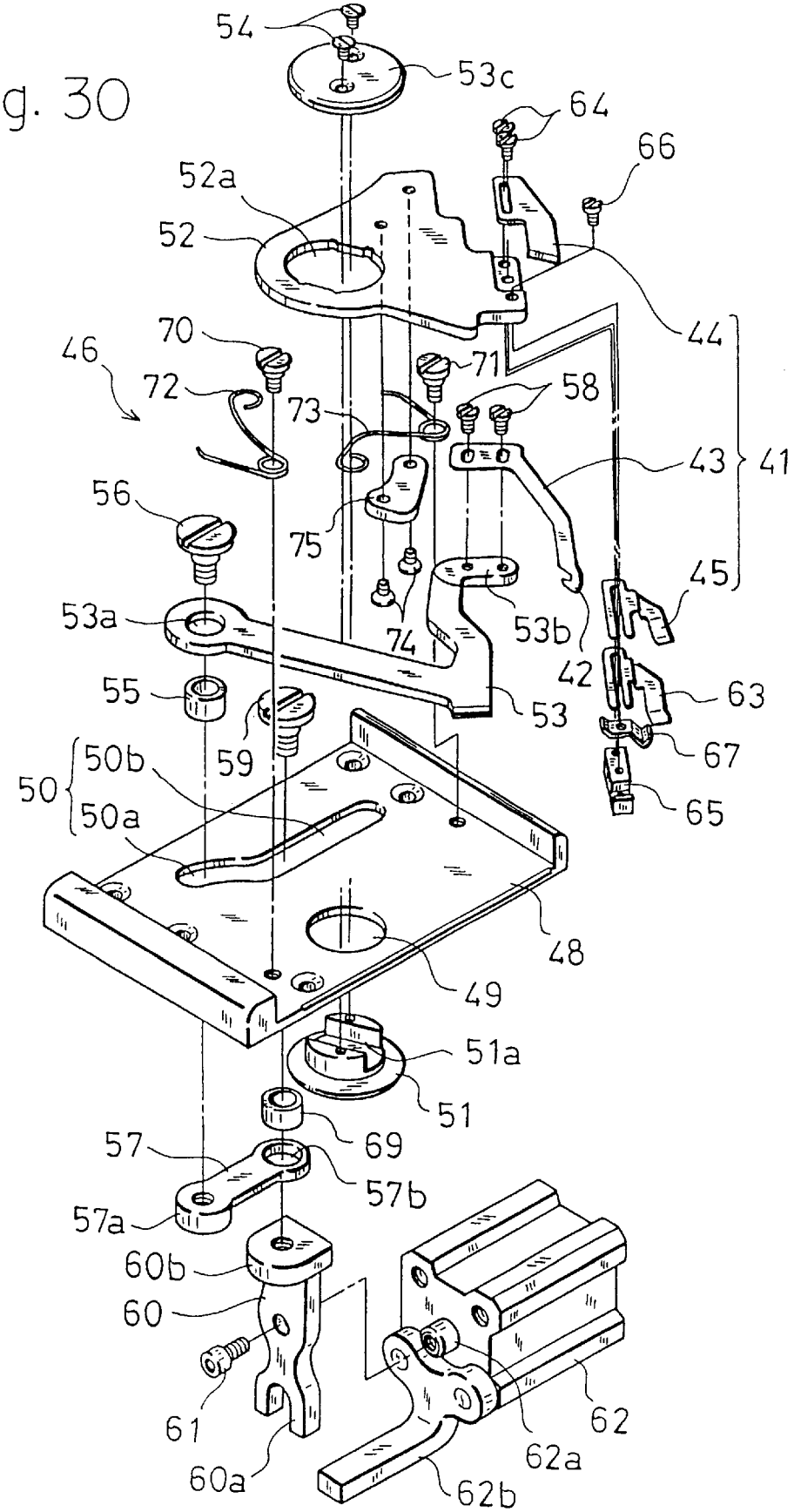
FIG. 30 is a perspective exploded view explaining the detail of rotary forward and backward drive mechanism for driving the same looper thread cutter.
Figure 31:
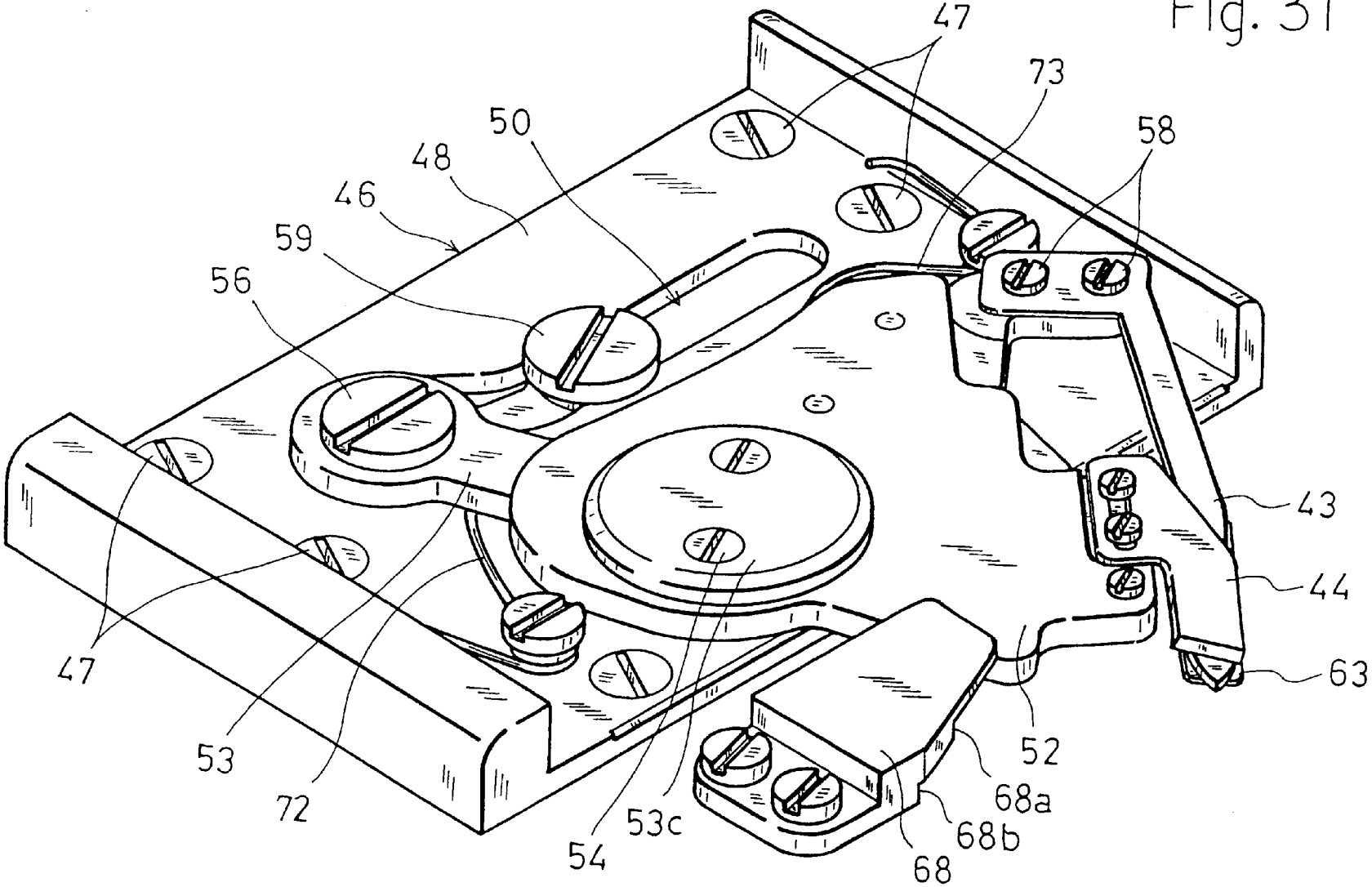
FIG. 31 is a perspective view of the assembled state explaining the detail of the same rotary forward and backward drive mechanism.

The rotary oscillating mechanism 46 and the relation between this mechanism 46 and the members 43, 44, 45 are as shown in FIG. 30 and FIG. 31. In a base plate 48 fixed to the cylinder bed B through a screw 47, a circular hole 49 and a bent slot 50 for a hook knife motion guide are formed. A rotary member 51 is rotatably fitted in the circular hole 49. In the upper surface of the rotary member 51, a groove 51*a* extending in its radial direction is formed, and an intermediate part of a nearly L-shaped oscillating arm 53 is slidably fitted into this groove 51*a*. The upper end side of the rotary member 51 is fitted into an elliptical hole 52*a* formed in a knife support stand 52, and at the upper end of the rotary member 51, a guide plate 53*c* is fixed with a screw 54. Accordingly, the oscillating arm 53, knife support stand 52 and base plate 48 are held by the rotary member 51 and guide plate 53*c*. The rotary member 51 and guide plate 53*c* are held on the base plate 48 rotatably within the circular hole 49. The oscillating arm 53 and knife support stand 52 are guided by the rotary member 51 slidably and rotatably.

A slider 55 is fitted into the bent slot 50 and a circular hole 53*a* provided at one end of the oscillating arm 53. The slider 55 is fitted at one end 57*a* of a link 57 by a screw 56, and the link 57 is coupled to the oscillating arm 53 rotatably about the circular hole 53*a* of the oscillating arm 53. At the other end 53*b* of the oscillating arm 53, a base end of the hook knife 43 is fixed by a screw 58. A slider 69 is fitted to a circular hole 57*b* provided at the other end of the link 57 and bent slot 50. The slider 69 is mounted on the upper end 60b of an operation piece 60 by a screw 59. The operation piece 60 is fixed to a piston rod 62*a* of an air cylinder 62 by a screw 61. A guide piece 62*b* is fixed to the air cylinder 62, and is fitted into a bifurcated part 60*a* provided at the lower end of the operation piece 60, so that the operation piece 60 is prevented from rotating about the piston rod 62*a*.

The receiving knife 44, pressing spring 45, and thread gripping spring 63 are held between a screw 64 and bracket 65, and mounted on the outer circumference of the knife support stand 52 so as to be adjustable in its position. The pressing force of the thread gripping spring 63 to the hook knife 43 is adjusted by a pressure adjusting spring 67 fitted to the knife support stand 52 through a screw 66, and its adjustment is done by tightening the screw 66 and pressure adjusting spring 67.

As shown in FIG. 27 to FIG. 29 and FIG. 31, a regulating member 68 is disposed in the cylinder bed B. This regulating member 68 comprises a regulating section 68*a* for the knife support stand 52 and a regulating section 68*b* for the oscillating arm 53. In the base plate 48, torsion coil springs 72, 73 are fitted by screws 70, 71. The torsion coil spring 72 abuts against a dent 52*b* positioning on the major axis of the elliptical hole 52*a* of the knife support stand 52 at one end, and abuts against the inner side 48*a* of the base plate 48 at other end. The torsion coil spring 73 abuts against a stopper 75 fitted to the knife support stand 52 by a screw 74 at one end, and abuts against the inner side 48*b* of the base plate 48 at other end. By the torsion coil spring 72, 73, the knife support stand 52 is thrust so as to rotate about the rotary member 51 and slide along the major axis of the elliptical hole 52*a*. And a guide plane 75*a* of the stopper 75 abuts against the leading end of the oscillating arm 20.

In the rotary forward and backward driving mechanism 46 thus constructed, as shown in FIG. 27, it is the state of the origin position where the slider 55 is engaged with an end 50*a* of the bent slot 50. When the air cylinder 62 is driven in one direction from this state, its driving force is transmitted to the link 57 through the operation piece 60, and the slider 69 moves along the bent slot 50. Along with this move, the oscillating arm 53 slides in the groove 51*a* of the rotary member 51, and rotates about the center of rotation of the rotary member 51. At this time, the knife support stand 52 is moved by the torsion coil springs 72, 73 until the knife support stand 52 abuts against the regulating section 68*a* of the regulating member 68. That is, the hook knife 43, receiving knife 44 and pressing spring 45 of the looper thread cutter 41 move together up to the position in FIG. 28. Moreover, when the air cylinder 62 is continuously driven in one direction, the slider 55 moves along the linear section 50*b* of the bent slot 50. By this move, only the oscillating arm 53 moves until abutting against the regulating section 68*b* of the regulating member 68, and the hook knife 43 moves in the direction of arrow b as shown in FIG. 29. When the air cylinder 62 is driven in the other direction, only the hook knife 43 moves from the state in FIG. 29 to the waiting position of the receiving knife 44 and pressing spring 45 as shown in FIG. 28. Moreover, when the air cylinder 62 is continuously driven in the other direction, the hook knife 43, receiving knife 44 and pressing spring 45 move together up to the origin position in FIG. 27.

At the right side of the throat plate 1 in FIG. 1, that is, at the base end of the cylinder bed B, as shown in FIG. 32 to FIG. 38, the needle thread cutter 25 is disposed. This needle thread cutter 25 is the same as explained in the apparatus for preventing a seam from raveling used in the first and third embodiments, and the same reference numerals are given to the corresponding parts, and their description is omitted herein. The construction of the looper 3 is the same as explained in the apparatus for preventing a seam from raveling used in the first and third embodiments, and the same reference numerals are given to the corresponding parts, and the description is omitted.

Referring now to FIG. 32 to FIG. 37, the operation for preventing a sewing thread from raveling at the end of sewing of a double chain stitch S in a fourth embodiment is explained by using the thus constructed apparatus for preventing a seam from raveling in the double chain stitch sewing machine.

Figure 32:
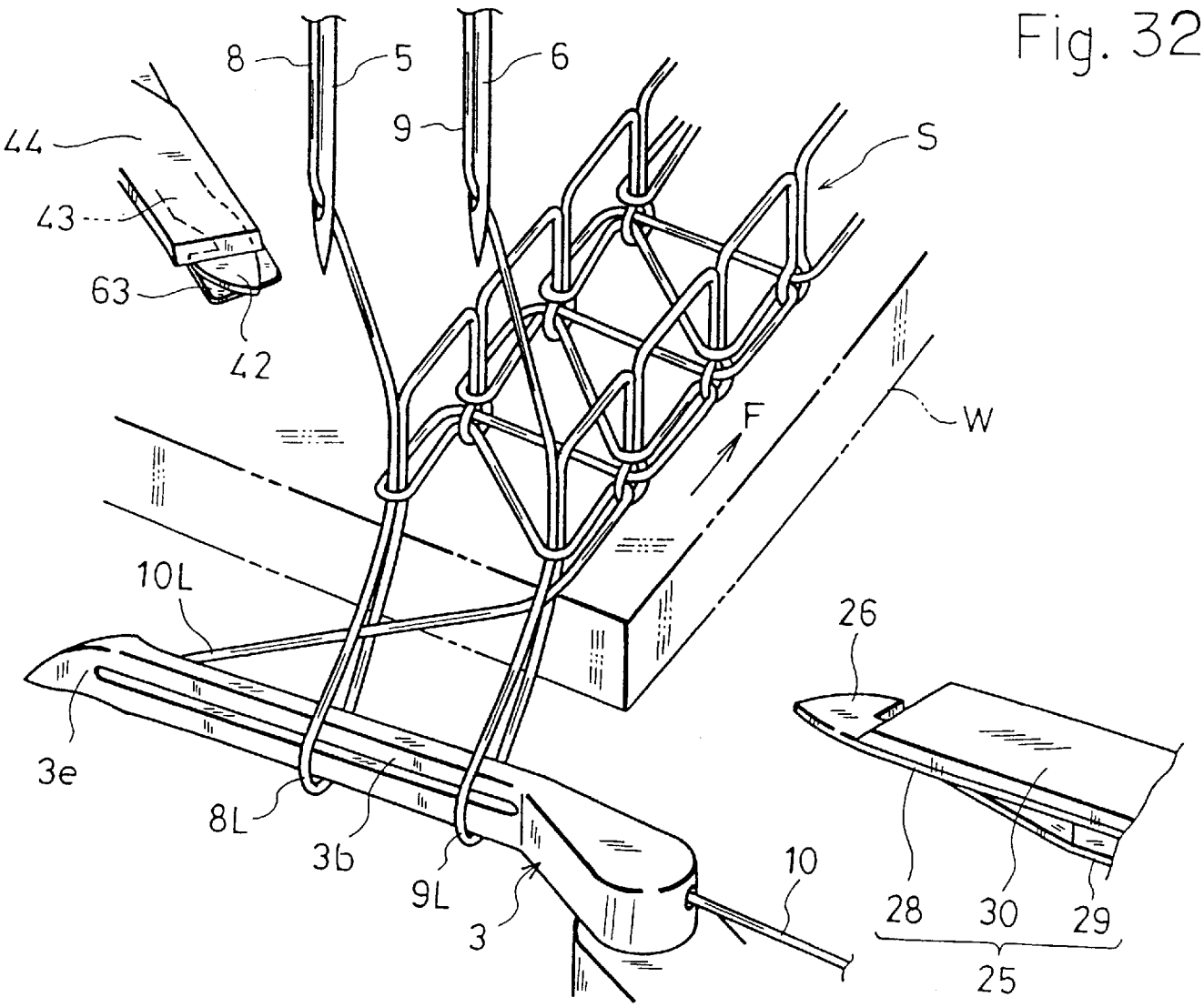
FIG. 32 is a magnified perspective view showing a first operation state of essential parts at the end of sewing in a fourth embodiment using the apparatus for preventing a seam from raveling in FIG. 27.
Figure 33:
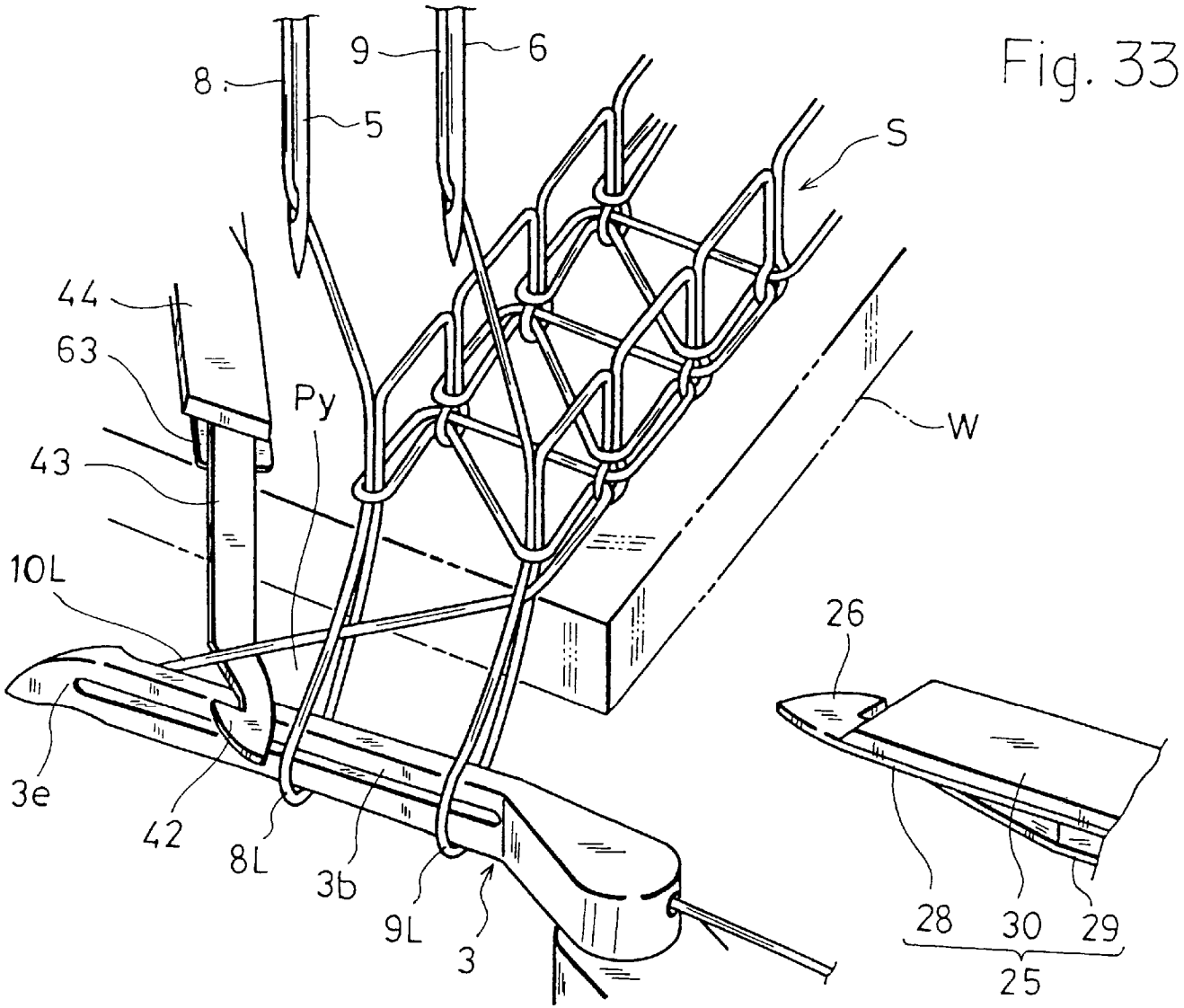
FIG. 33 is a magnified perspective view showing a second operation state of essential parts at the end of sewing in the fourth embodiment.

In this double chain stitch sewing machine, the cloth W set on the throat plate 1 is fed in the direction of the arrow F by a feed dog not shown in the drawing, and a double chain stitch S as indicated by the stitch symbol 406 is formed by the needle threads 8, 9 passed through the left and right needles 5, 6 and the looper thread 10 passed through the looper 3. Near the end point of sewing of the stitch S, as shown in FIG. 32, where the needles 5, 6 ascend nearly to the top dead center, and the looper 3 is nearly at the forward position, the air cylinder 62 in the rotary forward and backward driving mechanism 46 is driven in one direction, and the entire looper thread cutter 41 is moved from the origin position in FIG. 27 to the position in FIG. 29. As a result, the hook 42 of the hook knife 43 advances, as shown in FIG. 33, into a triangular space Py of threads formed of the looper thread loop 10L consecutive to the looper 3 from the cloth W and the left side needle thread loop 8L out of the needle thread loops 8L, 9L engaged with the looper 3.

Figure 34:
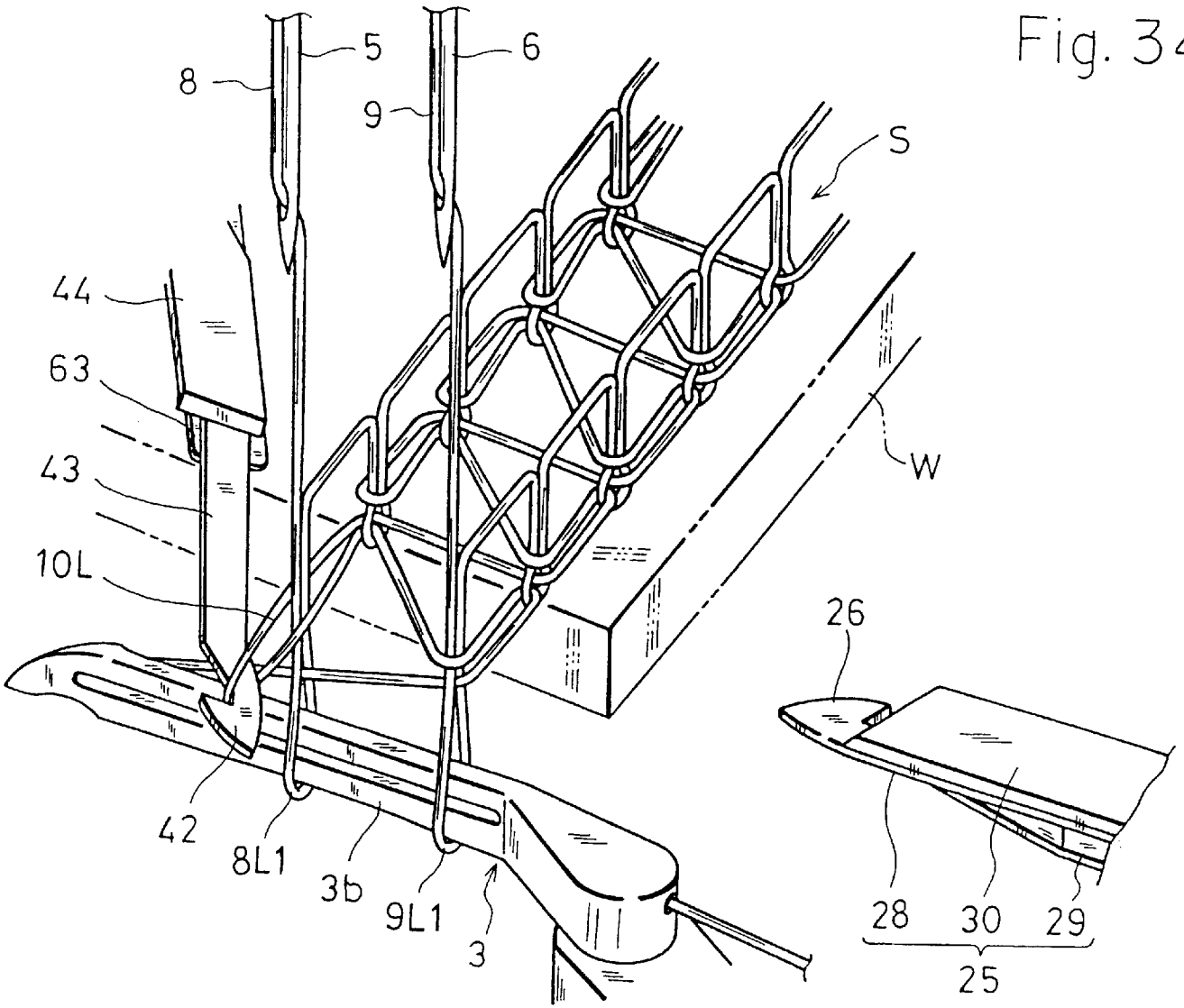
FIG. 34 is a magnified perspective view showing a third operation state of essential parts at the end of sewing in the fourth embodiment.

In this state, that is, in the state of the hook 42 of the hook knife 43 advanced into the triangular space Py of threads, when the sewing machine is driven for one stitch, the needles 5,6 fall into the triangular space of threads formed by the looper thread loop 10L and needle thread loops 8L, 9L, and the looper 3 moves backward through the front side of the needles 5, 6. At this time, the looper thread loop 10L is engaged and held with the hook 42 at the front side of the needle 5. As the looper 3 moves again to the forward position, the needle thread loops 8L1, 9L1 newly formed by the needles 5, 6 are captured by the looper 3 to be in the state as shown in FIG. 34.

In succession, the air cylinder 62 is driven in the other direction, and the hook knife 43 of the looper thread cutter 41 is moved form the state in FIG. 29 to the waiting position of the receiving knife 44 and pressing spring 45 as shown in FIG. 28. As a result, the looper thread loop 10L engaged and held in the hook 42 is cut off by the receiving knife 44, and the thread end 10*f* of the looper thread 10 consecutive to the cloth W is short, and the cut-off thread end 10*e* of the looper 3 side is pinched and held by the hook knife 43 and pressing spring 45.

Figure 35:
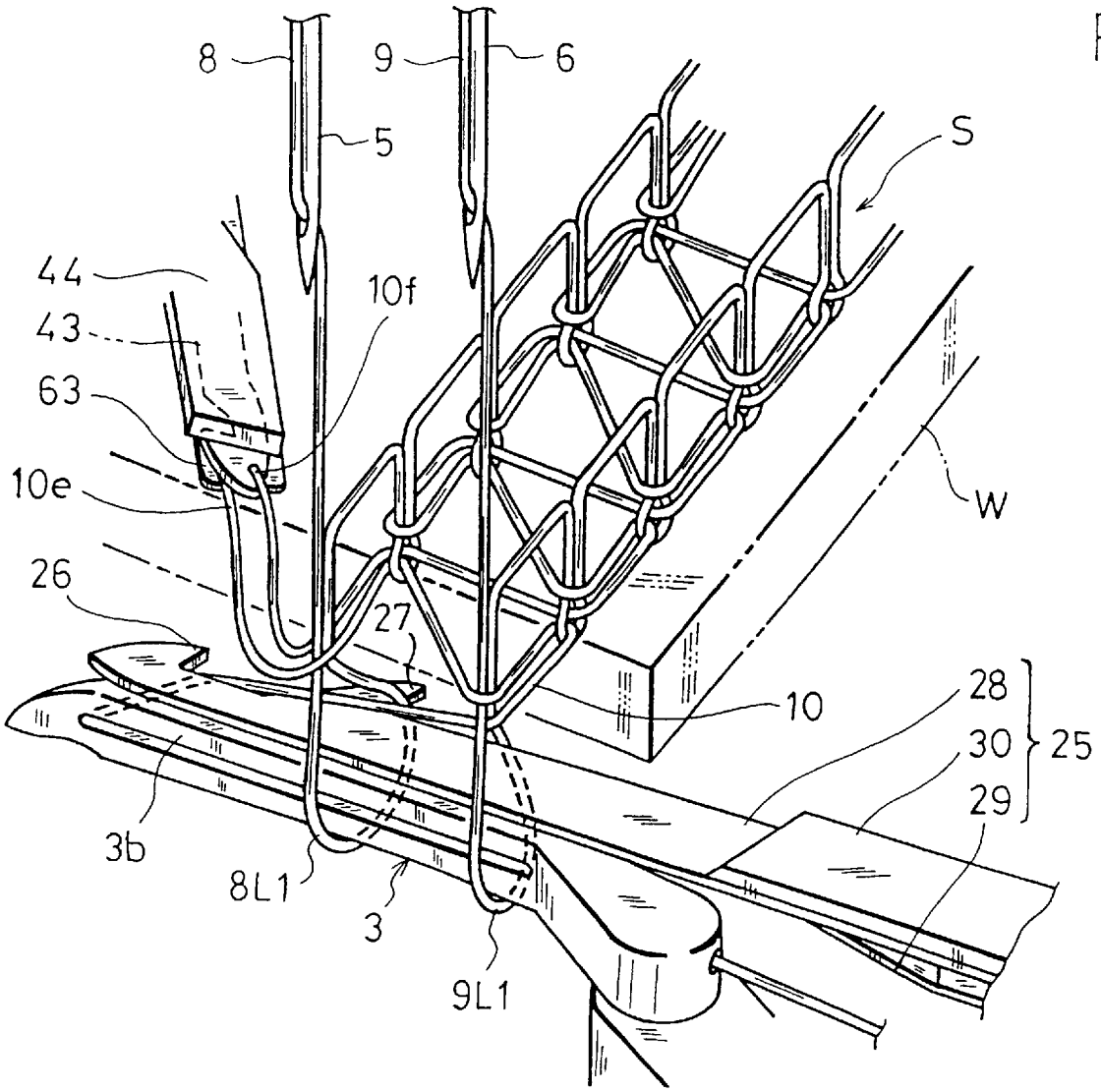
FIG. 35 is a magnified perspective view showing a fourth operation state of essential parts at the end of sewing in the fourth embodiment.

Successively, the hook knife 28, receiving knife 30 and pressing spring 29 in the needle thread cutter 25 are changed over from the waiting position to the action position by the air cylinder or solenoid not shown in the drawing, and the hook knife 28 is moved forward to the left along the upper part of the blade portion 3*b* of the looper 3, and, as shown in FIG. 35, the hook knife 28 passes through the loop of the needle thread loops 8L1, 9L1, and the hooks 26, 27 of the hook knife 28 are moved to the left side of the needle drop point position.

Figure 36:
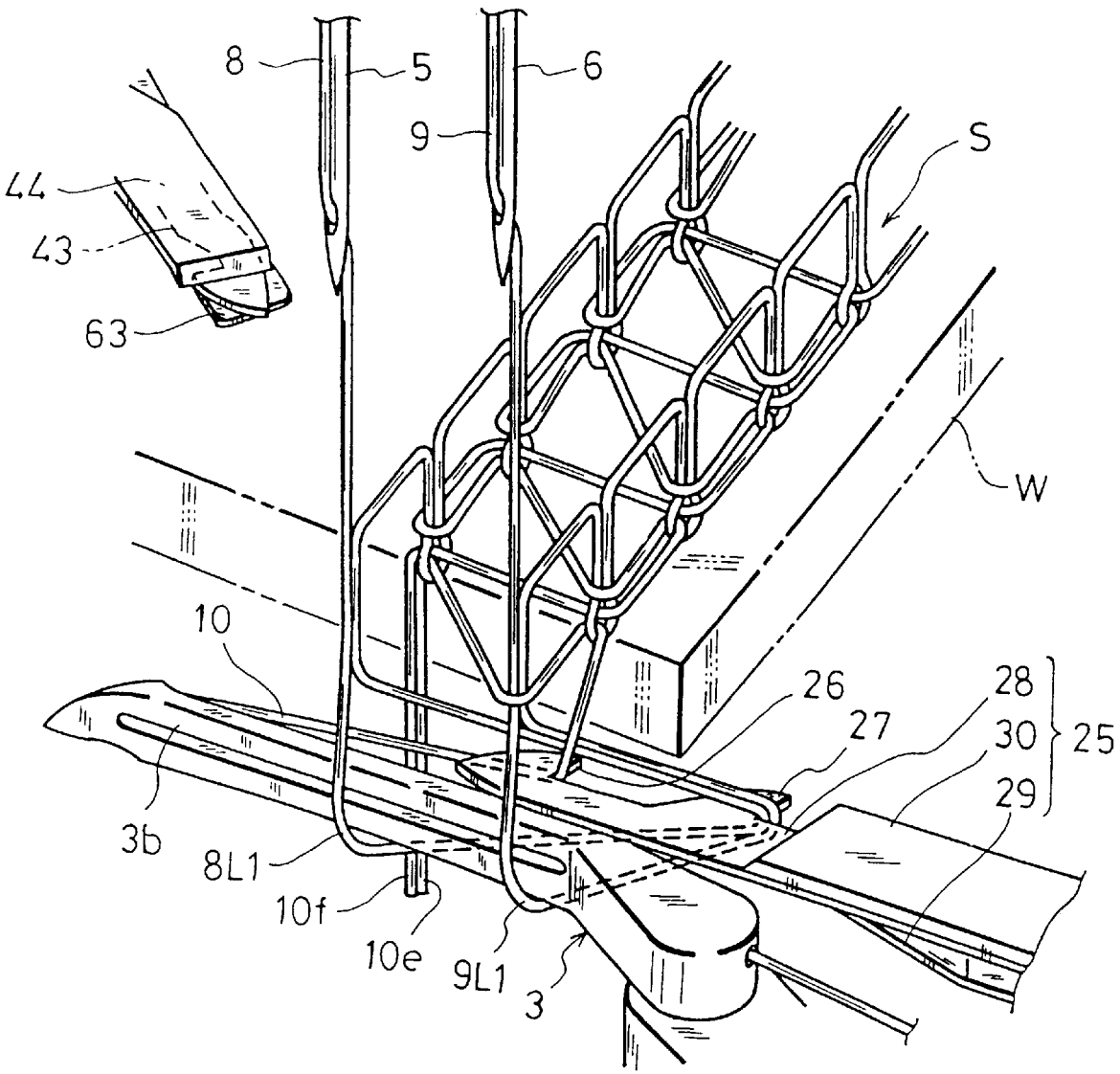
FIG. 36 is a magnified perspective view showing a fifth operation state of essential parts at the end of sewing in the fourth embodiment.
Figure 37:
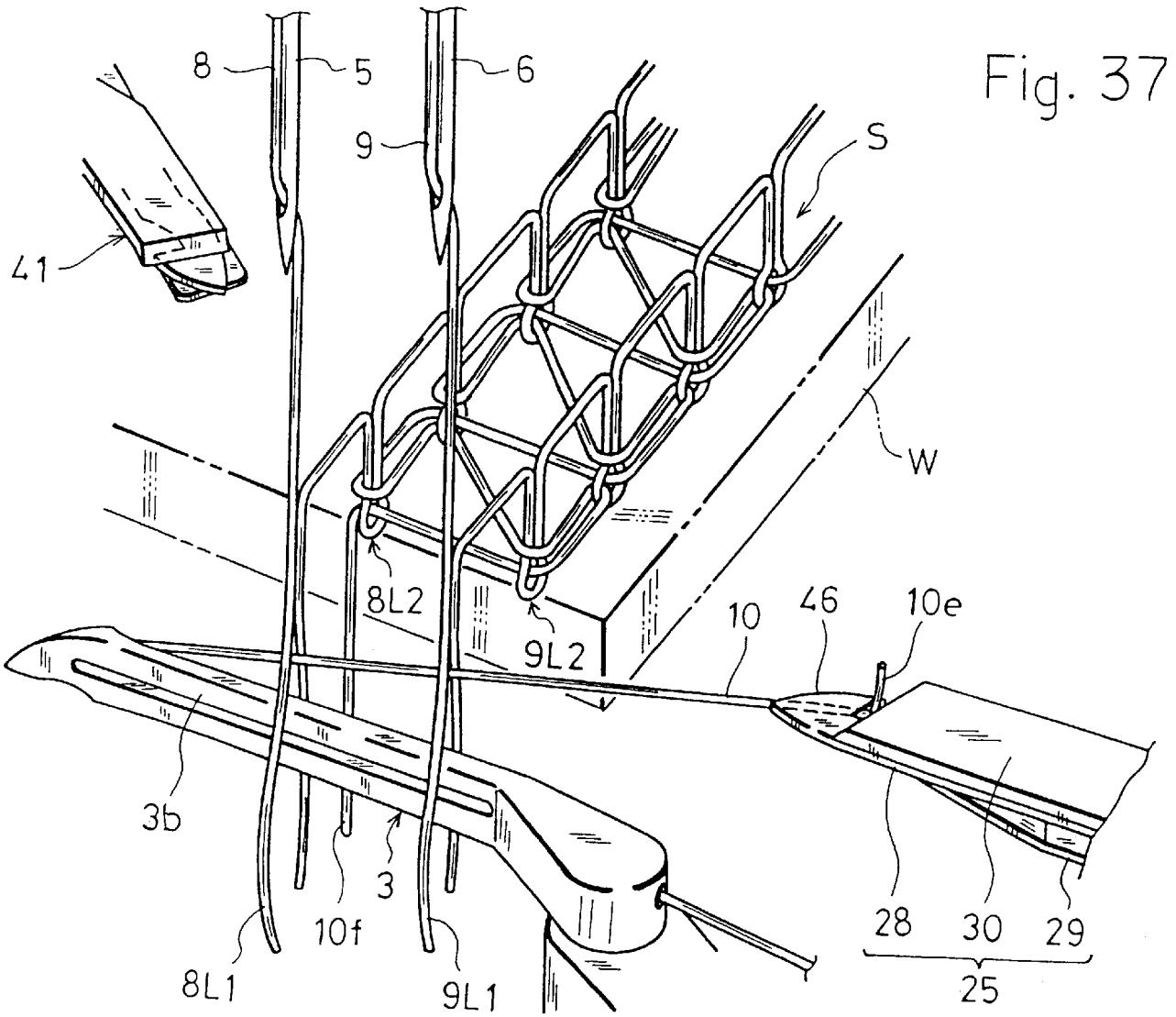
FIG. 37 is a magnified perspective view showing a sixth operation state of essential parts at the end of sewing in the fourth embodiment.

Afterwards, the air cylinder 62 in the rotary forward and backward driving mechanism 46 is further moved in the other direction, and the hook knife 43, receiving knife 44 and pressing spring 45 of the looper thread cutter 41 return from the waiting position in FIG. 28 to the origin position in FIG. 27. The hook knife 28 in the needle thread cutter 25 is moved backward to the right along the upper part of the blade portion 3*b* of the looper 3. At this time, as shown in FIG. 36, the loop thread 10 is engaged with the hook 26, and the needle thread loops 8L1, 9L1 are engaged and captured by the hook 27. In this state, the hook knife 28 is further moved to the right, and the needle thread loops 8L1, 9L1 engaged with the hook 27 are cut off by the receiving knife 30, while the looper thread 10 engaged with the hook 26 is gradually pulled out form the needle thread loops 8L2, 9L2 at the sewing end point. The hook knife 28, receiving knife 30 and pressing spring 29 are changed over from the action position to the waiting position. The thread end 10*e* of the looper thread 10 being cut off is pinched and held between the pressing spring 29 and hook knife 28 as shown in FIG. 37 to wait for next sewing operation.

Thus, at the sewing end of the double chain stitch S, by moving the hook 42 of the hook knife 43 into the triangular space Py of threads formed by the looper thread loop 10L consecutive to the looper 3 from the cloth W and the needle thread loop 8L engaged with the looper 3, cutting of the looper thread loop 10L engaged and held by the hook 42, and cutting off the needle thread loops 8L1, 9L1, the length of the thread end 10*f* of the looper thread 10 consecutive to the cloth W side can be shortened, and manual labor for cutting off the thread end is not necessary.

In particular, according to the apparatus used in the method of preventing a sewing thread from raveling at the end of sewing of a double chain stitch in the fourth embodiment, by sharing the hook knife and looper thread engaging means of the looper thread cutter and simplifying the rotary drive mechanism for the forward and backward driving mechanism, the entire apparatus can be composed in a compact structure.

Figure 38:
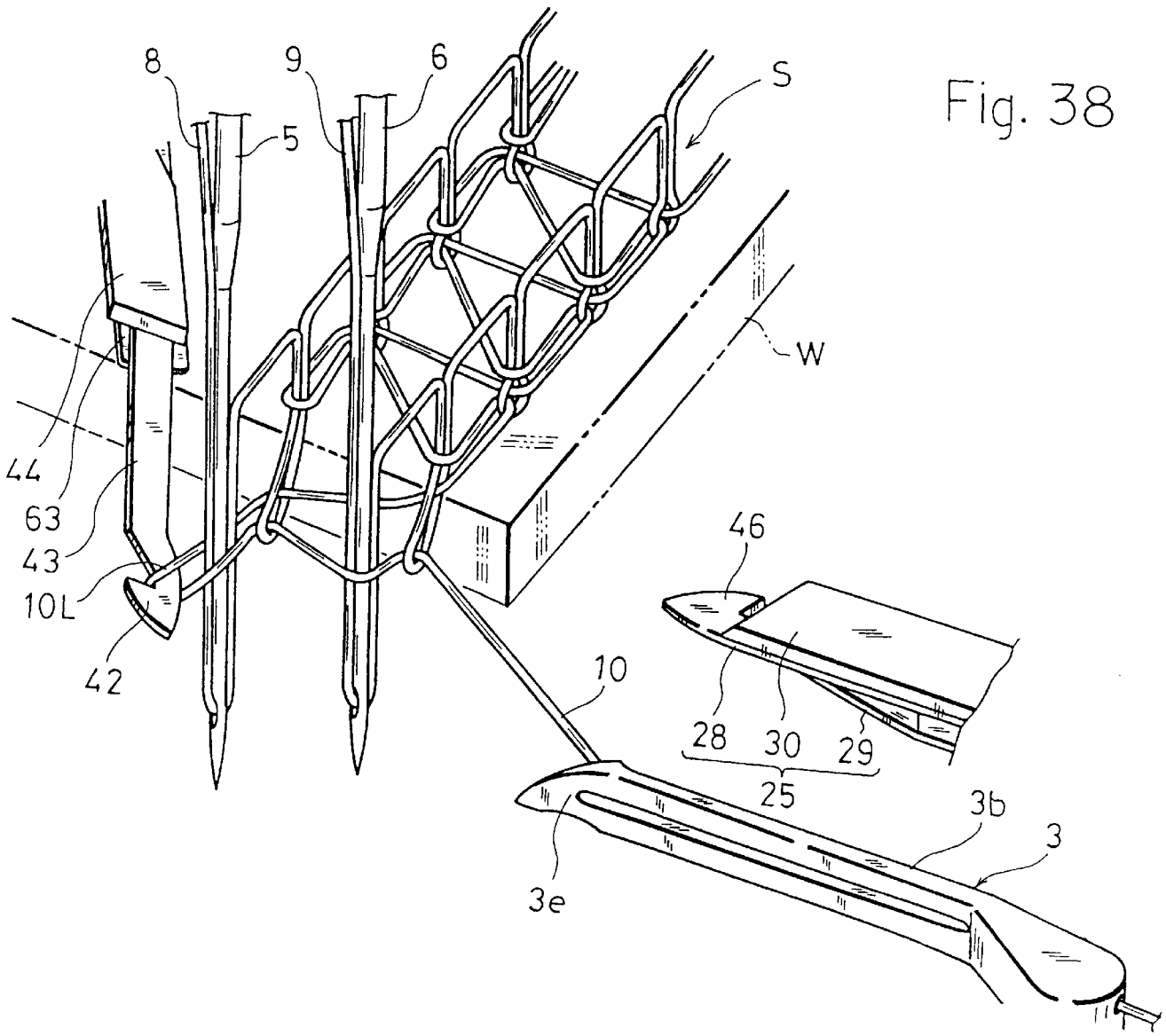
FIG. 38 is a magnified perspective view showing a third operation state of essential parts at the end of sewing in a fifth embodiment using the apparatus in FIG. 2 for preventing a seam from raveling.

In the fourth embodiment, while the hook 42 of the hook knife 43 gets into the triangular space Py of the threads (see FIG. 33), the sewing machine is driven for one stitch to move the looper 3 to the forward position, as a result, the hook 42 is engaged with the looper thread 10 and the looper thread loop 10L is formed at the hook 42. But alternatively, while the hook 42 of the hook knife 43 gets into the triangular space Py of threads, the sewing machine may be driven for a half stitch to move the looper 3 to the backward position as shown in FIG. 38. As a result, the looper thread loop 10L is already engaged and held in the hook 42. In this state, the air cylinder 62 of the rotary forward and backward driving mechanism 46 is driven in the other direction, and the hook knife 43 of the looper thread cutter 41 is moved from the state in FIG. 29 to the waiting position of the receiving knife 44 and pressing spring 45 as shown in FIG. 28. Therefore, the looper thread loop 10L engaged and held in the hook 42 is cut by the receiving knife 44. Thereafter, the sewing machine is driven for a half stitch from the backward position of the looper 3 to move to the forward position as shown in FIG. 35. The new needle thread loops 8L1, 9L1 captured by the looper 3 is cut off. In this case, just as in the third embodiment, the length of the thread end 10*f* of the looper thread 10 consecutive to the cloth W may be cut short, and raveling from the seam at the sewing end point can be prevented.

Also in the fourth embodiment, the thread cutting operation of the looper thread cutter 41 is started earlier than the thread cutting operation of the needle thread cutter 25, but they maybe started simultaneously or in reverse order. In such a case, by moving the hook 26 up to the receiving knife 30, it is preferred to cut off the looper thread 10 engaged with the hook 26. Further, detail is not explained about driving of the sewing machine for one stitch or half stitch or controlling of the start of the cutters 41, 25, but it is possible to employ known means regarding the rotation control device of a sewing machine motor and control by a rotation signal detector provided on the sewing machine main shaft.

What is claimed is:

1. A method for preventing a seam from raveling in a double chain stitch sewing machine, having at least one needle moving vertically through which a needle thread is passed, and a looper through which a looper thread is passed, for forming a double chain stitch by collaboration of the looper thread and the needle thread, while the looper moves forward and backward between a forward position and a backward position across the needle, said method comprising the steps of:

hooking and engaging a looper thread consecutive to the looper from a cloth by an engaging means when the looper is in an advanced state relative to the forward position near the sewing end point;

cutting off the looper thread hooked and engaged on the engaging means at its engaging portion;

cutting off a needle thread loop consecutive to the needle from the cloth through the looper at a position between the cloth and the looper in a state when the looper is advanced again from the backward position to the forward position as the sewing machine is driven; and pulling out an end of a cut looper thread left over at the looper side from a final needle thread loop formed in the cloth.

2. A method for preventing a seam from raveling in a double chain stitch sewing machine of claim 1, further comprising the step of: driving the sewing machine for one stitch to move the looper once to the backward position and advance it again to the forward position, between said step of hooking and engaging the looper thread and said step of cutting off the engaging portion of the looper thread.

3. A method for preventing a seam from raveling in a double chain stitch sewing machine of claim 1, wherein said step of cutting off the engaging portion of the looper thread occurs in a state when the looper is moved once to the backward position as the sewing machine is driven for a half stitch after said step of hooking and engaging the looper thread and, thereafter said step of cutting off the needle thread looper occurs in a state when the looper is moved again to the forward position as the sewing machine is driven for a half stitch.

4. A method for preventing a seam from raveling in a double chain stitch sewing machine of claim 1, further comprising the step of: cutting off a looper thread consecutive to the looper from the cloth between the cloth and the looper, simultaneously with or before or after said step of cutting off the needle thread loop.

5. A method for preventing a seam from raveling in a double chain stitch sewing machine having at least one needle moving vertically through which a needle thread is passed, and a looper through which a looper thread is passed, for forming a double chain stitch by collaboration of the looper thread and the needle thread, while the looper moves forward and backward between a forward position and a backward position across the needle, said method comprising the steps of:

hooking and engaging a looper thread consecutive to the looper from a cloth by an engaging means when the looper is in an advanced state relative to the forward position near the sewing end point;

cutting off the looper thread hooked and engaged on the engaging means in a state when the looper is moved backward to the backward position from the forward position as the sewing machine is driven; and cutting off a needle thread loop consecutive to the needle from the cloth through the looper at a position between the cloth and the looper in a state when the looper is advanced again from the backward position to the forward position as the sewing machine is driven.

6. A method for preventing a seam from raveling in a double chain stitch sewing machine of claim 5, further comprising the step of: cutting off a looper thread consecutive to the looper from the cloth between the cloth and the looper, simultaneously with or before or after said step of cutting off the needle thread loop.

7. A method for preventing a seam from raveling in a double chain stitch sewing machine having at least one needle moving vertically through which a needle thread is passed, and a looper through which a looper thread is passed, for forming a double chain stitch by collaboration of the looper thread and the needle thread, while the looper moves forward and backward between a forward position and a backward position across the needle, said method comprising the steps of:

moving an engaging means into a triangular space of threads formed by a looper thread loop consecutive to the looper from a cloth and a needle thread loop engaged with the looper when the looper is in an advanced state relative to the forward position near the sewing end point;

engaging and holding the looper thread loop of said thread triangular space by the engaging means as the sewing machine is driven;

cutting off the looper thread loop held in the engaging means; and cutting off a needle thread loop engaged with the looper in a state when the looper is advanced again to the forward position.

8. A method for preventing a seam from raveling in a double chain stitch sewing machine of claim 7, further comprising the step of: driving the sewing machine for one stitch to move the looper once to the backward position and advance it again to the forward position, between said step of moving the engaging means into the triangular space of threads and said step of engaging and holding the looper thread loop by the engaging means.

9. A method for preventing a seam from raveling in a double chain stitch sewing machine of claim 7, wherein said step of engaging and holding the looper thread loop by the engaging means occurs in a state when the looper is moved once to the backward position as the sewing machine is driven for a half stitch after said step of moving the engaging means into the triangular space of threads and, thereafter said step of cutting off the needle thread loop occurs in a state when the looper is moved again to the forward position as the sewing machine is driven for a half stitch.

10. An apparatus for preventing a seam for raveling in a double chain stitch sewing machine having a needle drop point disposed in a sewing machine bed, at least one needle moving vertically through which a needle thread is passed, and a looper through which a looper thread is passed, for forming a double chain stitch by collaboration of the looper thread and the needle thread, while the looper moves forward and backward between a forward position and a backward position across the needle, said apparatus comprising:

looper thread engaging means for engaging a looper thread between the needle drop point and a leading end of the looper at its forward position;

a looper thread cutter for cutting off the looper thread engaged with the looper thread engaging means in its engaging portion;

needle thread engaging means for engaging a needle thread loop consecutive to the needle from a cloth through the looper at a position between the cloth and the looper;

a needle thread cutter for cutting off the needle thread engaged with the needle thread engaging means in its engaging portion; and looper thread pulling means for pulling out an end portion of a cut looper thread left over at the looper side from a final needle thread loop formed in the cloth.

11. An apparatus for preventing a seam from raveling in a double chain stitch sewing machine of claim 10, further comprising: another looper thread cutter for cutting said looper thread at a position between the cloth and the looper, simultaneously with or before or after cutting by the needle thread cutter.

12. An apparatus for preventing a seam from raveling in a double chain stitch sewing machine of claim 10, wherein said looper thread cutter comprises: a hook knife used also as said looper engaging means for engaging with the looper thread at the position between the needle drop point and the leading end of the looper when the looper is at the forward position; and a receiving knife for cutting the engaging portion of the looper thread in collaboration with the hook knife when the hook knife engaged with the looper thread is moved back to a specified position while the looper is at the backward position.

13. An apparatus for preventing a seam from raveling in a double chain stitch sewing machine of claim 11, wherein said another looper thread cutter and said needle thread cutter comprises: a hook knife used also as said needle thread engaging means for engaging with both the needle thread consecutive to the needle from the cloth through the looper and the looper thread consecutive to the looper from the cloth after said hook knife of said looper thread cutter has retreated to said position between the cloth and the looper; and a receiving knife for cutting each engaging portion of the looper thread and needle thread in collaboration with the hook knife when the hook knife has retreated to a specified position.

14. An apparatus for preventing a seam from raveling in a double chain stitch sewing machine having at least one needle moving vertically through which a needle thread is passed, and a looper through which a looper thread is passed for forming a double chain stitch by collaboration of the looper thread and the needle thread, while the looper moves forward and backward between a forward position and a backward position across the needle, said apparatus comprising:

looper thread engaging means for moving into a triangular space of threads formed by a looper thread loop consecutive to the looper from a cloth and a needle thread loop engaged with the looper when the looper is in an advanced state to the forward position, and for engaging and holding the looper thread loop of said thread triangular space by moving the looper to backward position;

a looper thread cutter for cutting off the looper thread loop held in said engaging means; and a needle thread cutter for cutting off a needle thread loop engaged with the looper in a state when the looper is advanced again to the forward position.

15. An apparatus for preventing a seam from raveling in a double chain stitch sewing machine of claim 14, wherein said looper thread cutter has a rotary forward and backward drive mechanism, and comprises: a hook knife used also as said looper thread engaging means; and a receiving knife for cutting the looper thread loop in collaboration with the hook knife when the hook knife is moved back to a specified position while the looper is at the backward position.

* * * * *